US006350569B1

(12) United States Patent
Watanabe et al.

(10) Patent No.: US 6,350,569 B1
(45) **Date of Patent: *Feb. 26, 2002**

(54) HEAT-DEVELOPABLE PHOTOGRAPHIC MATERIAL

(75) Inventors: Katsuyuki Watanabe; Hiroyuki Suzuki; Masaru Takasaki; Shigeo Hirano, all of Minami-ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/538,725

(22) Filed: Mar. 30, 2000

(30) Foreign Application Priority Data

Mar. 30, 1999 (JP) ..... 11-089773

(51) Int. Cl.[7] ..... G03C 1/498; G03C 1/321

(52) U.S. Cl. ..... 430/619; 430/600; 430/607; 430/613; 430/614; 430/617

(58) Field of Search ..... 430/619, 600, 430/607, 613, 614, 617

(56) References Cited

U.S. PATENT DOCUMENTS

| | | | | |
|---|---|---|---|---|
| 3,874,946 | A | | 4/1975 | Costa et al. |
| 5,656,419 | A | * | 8/1997 | Toya et al. |
| 5,952,167 | A | * | 9/1999 | Okada et al. |

FOREIGN PATENT DOCUMENTS

| | | | |
|---|---|---|---|
| EP | 0903629 | A1 | 3/1999 |
| EP | 0957398 | A1 | 11/1999 |
| JP | 09265150 | | 10/1997 |

* cited by examiner

*Primary Examiner*—Thorl Chea
(74) *Attorney, Agent, or Firm*—Birch, Stewart, Kolasch & Birch, LLP

(57) ABSTRACT

A heat-developable photographic material which contains a particular class of polyhalogenated organic compound having a water-soluble group in one or more layers on the side of the image-forming layer. The heat-developable photographic material can be obtained at a low cost and has much reduced fog and excellent storage stability.

15 Claims, 1 Drawing Sheet

HEAT-DEVELOPABLE PHOTOGRAPHIC MATERIAL

FIELD OF THE INVENTION

The present invention relates to a heat-developable photographic material. More specifically, the present invention relates to a heat-developable photographic material which causes almost no fog and has excellent storage stability.

BACKGROUND OF THE INVENTION

A large number of photosensitive materials are known which have a photosensitive layer on a support and form an image by imaging exposure. An example of a system that enables environmental conservation or simplification of image formation includes a technique of forming an image by heat development.

In recent years, reduction of amount of waste processing solutions is strongly desired in the field of photomechanical processes from the standpoints of environmental protection and space savings. Techniques relating to photosensitive heat-developable materials for use in photomechanical processes are required which enables efficient exposure by a laser scanner or a laser image setter and formation of a clear black image having high resolution and sharpness. The photosensitive heat-developable materials can provide users with a simple and non-polluting heat development processing system that eliminates the use of solution-type processing chemicals.

Methods for forming an image by heat development are described, for example, in U.S. Pat. Nos. 3,152,904 and 3,457,075 and D. Morgan and B. Shely, Imaging Processes and Materials, "Thermally Processed Silver Systems" A, 8th ed., page 2, compiled by Sturge, V. Walworth and A. Shepp, Neblette (1969). The photosensitive material contains a reducible light-insensitive silver source (e.g., organic silver salt), a photocatalyst (e.g., silver halide) in a catalytically active amount, and a reducing agent for silver, which are usually dispersed in an organic binder matrix. This photosensitive material is stable at an ambient temperature, but when the material is heated at a high temperature (e.g., 80° C. or higher) after light exposure, silver is produced through an oxidation-reduction reaction between the reducible silver source (which functions as an oxidizing agent) and the reducing agent. The oxidation-reduction reaction is accelerated by catalytic action of a latent image generated upon exposure. The silver produced by the reaction of the reducible silver salt in the exposure region provides a black image and this presents a contrast to the non-exposure region to form an image.

Fog is a serious problem for heat-developable photographic materials. Various researches have been made to reduce the fog in silver halide photosensitive materials for thermal photography. For example, U.S. Pat. No. 3,589,903 discloses use of mercury salts. Furthermore, there have also been disclosed uses of carboxylic acids such as benzoic acid and phthalic acid (U.S. Pat. No. 4,152,160), benzoyl benzoic acid compounds (U.S. Pat. No. 4,784,939), indane or tetralincarboxylic acids (U.S. Pat. No. 4,569,906), dicarboxylic acids (U.S. Pat. No. 4,820,617), heteroaromatic carboxylic acids (U.S. Pat. No. 4,626,500), halogenated compounds (U.S. Pat. Nos. 4,546,075, 4,756,999, 4,452,885, 3,874,946 and 3,955,982), halogen molecules or halogen atoms bound to a heterocyclic ring (U.S. Pat. No. 5,028,523), palladium compounds (U.S. Pat. No. 4,103,312 and British Patent No. 1,502,670), iron family metals (U.S. Pat. No. 4,128,428), substituted triazoles (U.S. Pat. Nos. 4,123,374, 4,129,557 and 4,125,430), sulfur compounds (U.S. Pat. Nos. 4,213,784, 4,245,033, and JP-A-51-26019 [the abbreviation "JP-A" as used herein means an "unexamined published Japanese patent application"]), thiouracils (U.S. Pat. No. 4,002,479), sulfinic acid (JP-A-50-123331), metal salts of thiosulfonic acid (U.S. Pat. Nos. 4,125,403, 4,152,160 and 4,307,187), and combinations of metal salts of thiosulfonic acid and sulfinic acid (JP-A-53-20923 and JP-A-53-19825), thiosulfonic acid esters (JP-B-62-50810 [the abbreviation "JP-B" as used herein means an "examined Japanese patent publication"], JP-A-7-209797 and JP-A-9-43760).

There has also been disclosed use of disulphide compounds (JP-A-51-42529 and JP-B-63-37368). However, those compounds have drawbacks, for example, insufficient anti-fog effect, decrease of Dmax (maximum image density) and sensitivity at a larger addition amount and the like.

Further, polyhalogenated compounds are extremely effective materials as an antifoggant for dry silver photosensitive materials, and such compounds have been disclosed in JP-B-54-165, European Patent Nos. 605981A, 631176A, U.S. Pat. Nos. 4,546,075, 4,756,999, 4,452,885, 3,874,946 and 3,955,982. However, those compounds have also drawbacks, for example, insufficient anti-fog effect, degraded storage stability, increase of the cost of photosensitive materials because of a large added amount.

SUMMARY OF THE INVENTION

Accordingly, an object of the present invention is to provide a heat-developable photographic material which can be manufactured at a low cost, and which causes much reduced fog and has good storage stability. The aforementioned object was achieved by the present invention.

The present invention thus provides:

(1) a heat-developable photographic material which comprises, on a support, (a) a reducible silver salt, (b) a reducing agent, (c) a binder, and (d) at least one polyhalogenated compound represented by the following formula (1):

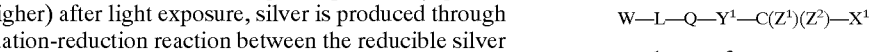

$$W—L—Q—Y^1—C(Z^1)(Z^2)—X^1$$

wherein $Z^1$ and $Z^2$ represent a halogen atom, $X^1$ represents a hydrogen atom or an electron withdrawing group, $Y^1$ represents —CO— group or —$SO_2$— group, Q represents an arylene group or a divalent heterocyclic group, L represents a bridging group, and W represents carboxyl group or a salt thereof, slufo group or a salt thereof, phosphoric acid group or a salt thereof, a hydroxyl group, a quaternary ammonium group, or a polyethyleneoxy group.

According to preferred embodiments of the aforementioned invention, there are provided:

(2) the aforementioned heat-developable photographic material, which contains a photosensitive silver halide;

(3) the aforementioned heat-developable photographic material according to the aforementioned material (1) or (2), wherein $Z^1$, $Z^2$ and $X^1$ represent a bromine atom, $Y^1$ represents —$SO_2$— group, Q represents an arylene group or a divalent heterocyclic group, L represents an alkylene group, —O— group, —CONR— group, —$SO_2$NR— group, or a group formed by a combination thereof wherein R represents a hydrogen atom or an alkyl group, provided that L contains at least one of —O— group, —NRCO— group, and —$SO_2$NR— group, and W represents carboxyl group or a salt thereof, slufo group or a salt thereof, phosphoric acid group or a salt thereof, a hydroxyl group, a quaternary ammonium group, or a polyethyleneoxy group; and (4) the aforementioned heat-developable photographic material which contains an ultrahigh contrast agent.

According to the present invention, there are provided heat-developable photographic materials with substantially no fog and excellent storage stability.

PREFERRED EMBODIMENT OF THE INVENTION

Figure 1:
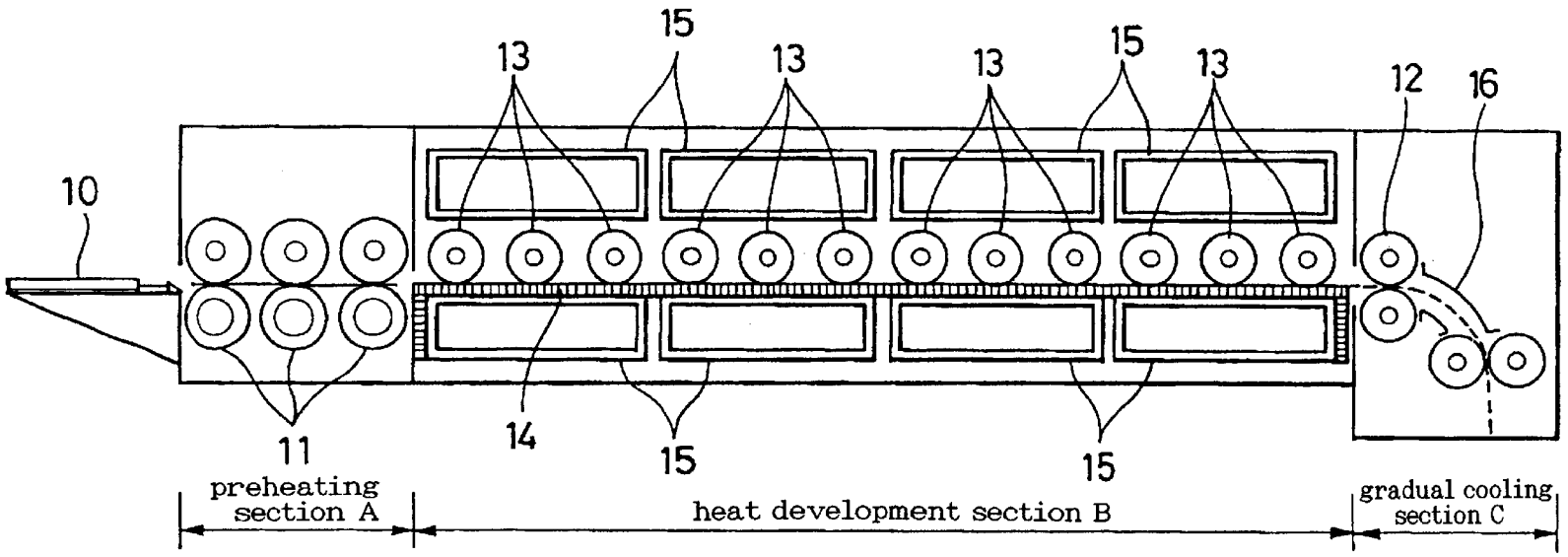
FIG. 1 is a side view of an exemplary heat developing apparatus used for the present invention. In the figure, there are shown a heat-developable photographic material 10, carrying-in roller pairs 11, carrying-out roller pairs 12, rollers 13, a flat surface 14, heaters 15, and guide panels 16. The apparatus comprises a preheating section A, a heat development section B, and a gradual cooling section C.

The present invention will be explained in detail below.

The heat-developable photographic material of the present invention comprises, on a support, an image-forming layer containing an organic silver salt as a reducible silver salt and a binder, and contains a reducing agent in one or more layers comprised of the image-forming layer. Preferably, the material further contains a photosensitive silver halide and an ultrahigh contrast agent. The image-forming layer is preferably a photosensitive layer containing a photosensitive silver halide. Further, the heat-developable photographic material contains a polyhalogenated compound represented by the formula (1) in one or more layers comprised of the image-forming layer. By the addition of said polyhalogenated compound, at even a smaller amount than that for polyhalogenated compounds having no water soluble functional group not falling within the scope of the present invention, fogs of non-image areas after heat treatment and decrease of sensitivity can be suppressed, and storage stability can be improved.

The compounds represented by the formula (1) will be explained in detail.

The formula (1) is as follows:

$$W—L—Q—Y^1—C(Z^1)(Z^2)—X^1$$

In the formula (1), $Z^1$ and $Z^2$ independently represent a halogen atom including fluorine, chlorine, bromine, and iodine. It is most preferred that both of $Z^1$ and $Z^2$ are bromine atoms.

In the formula (1), $X^1$ is a hydrogen atom or an electron withdrawing group. The electron withdrawing group used herein is a functional group having a positive value of the Hammett's functional group constant σp, and specific examples thereof include cyano group, an alkoxycarbonyl group, an aryloxycarbonyl group, a carbamoyl group, a sulfamoyl group, an alkylsulfonyl group, an arylsulfonyl group, a halogen atom, an acyl group, a heterocyclic group and the like. In the formula (1), $X^1$ is preferably a hydrogen atom or a halogen atom, and the most preferred is bromine atom.

In the formula (1), $Y^1$ is —CO— or —$SO_2$—, and is preferably —$SO_2$—.

In the formula (1), Q represents an arylene group or a divalent heterocyclic group.

The arylene group represented by Q in the formula (1) is preferably a monocyclic or condensed ring arylene group having 6–30 carbon atoms, preferably a monocyclic or condensed ring arylene group having 6–20 carbon atoms. Examples thereof include, for example, phenylene, naphthylene and the like, and it is most preferably a phenylene group. The arylene group represented by Q may be substituted. The functional group may be any group so long as it does not adversely affect photographic performances. Examples thereof include, for example, a halogen atom (fluorine atom, chlorine atom, bromine atom or iodine atom), an alkyl group (including an aralkyl group, a cycloalkyl group, an active methine group and the like), an alkenyl group, an alkynyl group, an aryl group, a heterocyclic group (including N-substituted nitrogen-containing heterocyclic group), a heterocyclic group containing a quaternized nitrogen atom (e.g., pyridino group), an acyl group, an alkoxycarbonyl group, an aryloxycarbonyl group, a carbamoyl group, carboxy group or a salt thereof, an imino group, an imino group substituted at the N atom, a thiocarbonyl group, a carbazoyl group, cyano group, a thiocarbamoyl group, an alkoxyl group (including a group containing repeating units of ethyleneoxy group or propyleneoxy group), an aryloxy group, a heterocyclyloxy group, an acyloxy group, an (alkoxy or aryloxy)carbonyloxy group, a carbamoyloxy group, a sulfonyloxy group, an acylamino group, a sulfonamido group, a ureido group, a thioureido group, an imido group, an (alkoxy or aryloxy) carbonylamino group, a sulfamoylamino group, a semicarbazide group, a thiosemicarbazide group, a hydrazino group, a quaternary ammonio group, an (alkyl or aryl) sulfonylureido group, a nitro group, an (alkyl, aryl or heterocyclyl)thio group, an acylthio group, an (alkyl or aryl)sulfonyl group, an (alkyl or aryl)sulfinyl group, slufo group or a salt thereof, a sulfamoyl group, a phosphoryl group, a group containing phosphoric acid amide or phosphoric acid ester structure, a silyl group and the like. These functional groups may further be substituted with the aforementioned functional groups.

Particularly preferred functional groups of the arylene group represented by Q in the formula (1) are an alkyl group, an alkoxy group, an aryloxy group, a halogen atom, cyano group, carboxyl group or a salt thereof, a salt of sulfo group and phosphoric acid group.

In the formula (1), the heterocyclic ring of the divalent heterocyclic group represented by Q may be a saturated or unsaturated 5- to 7-membered heterocyclic ring containing at least one of N, O and S atoms. The heterocyclic ring may consist of a single ring, or it may form a condensed ring with one or more other rings. Examples of the heterocyclic ring in the heterocyclic group represented by Q include, for example, pyridine, pyrazine, pyrimidine, benzothiazole, benzimidazole, thiadiazole, quinoline, isoquinoline, triazole and the like. These may have a functional group, and examples of the functional group include, for example, those mentioned for the aryl group represented by Q.

In the formula (1), Q is preferably an arylene group, and it is most preferably a phenylene group.

In the formula (1), L represents a bridging group such as an alkylene group (including an alkylidene group and a cyclic group, and preferably having 1–30 carbon atoms, more preferably 1–20 carbon atoms, most preferably 1–10 carbon atoms), an alkenylene group (preferably having 2–30 carbon atoms, more preferably 2–20 carbon atoms, most preferably 2–10 carbon atoms), an alkynylene group (preferably having 2–30 carbon atoms, more preferably 2–20 carbon atoms, most preferably 2–10 carbon atoms), a heterocyclic group (preferably having 1–30 carbon atoms, more preferably 1–20 carbon atoms, most preferably 1–10 carbon atoms), —O— group, —NR— group, —CO— group, —S— group, —SO— group, —$SO_2$— group, a group containing a phosphorus atom, a group composed of a combination of these groups (the group represented by R is a hydrogen atom, an alkyl group which may be substituted, or an aryl group which may be substituted, and it is preferably a hydrogen atom or an alkyl group).

The bridging group represented by L in the formula (1) may be substituted, and examples of the functional group include, for example, those mentioned for the arylene group represented by Q.

The bridging group represented by L in the formula (1) is preferably an alkylene group, —O— group, —CONR— group, —$SO_2$NR— group, or a group composed of a combination of these groups. L most preferably contains at least one of —O— group, —CONR— group and —$SO_2$NR— group. L may contain a cyclized portion when structurally permitted.

W in the formula (1) represents carboxyl group or a salt thereof (e.g., Na, K, ammonium salt), slufo group or a salt thereof (e.g., Na, K, ammonium salt), phosphoric acid group or a salt thereof (e.g., Na, K, ammonium salt), a hydroxyl group, a quaternary ammonium group (e.g., tetrabutylammonium, trimethylbenzylammonium) or a polyethyleneoxy group. W is preferably carboxyl group or a salt thereof, a salt of sulfo group, phosphoric acid group or a salt thereof, a hydroxyl group, a quaternary ammonium group or a polyethyleneoxy group, more preferably carboxyl group or a salt thereof, a salt of sulfo group or a hydroxyl group.

Specific examples of the compounds of the present invention will be shown below. However, the scope of the present invention is not limited to these examples.

(P-1)

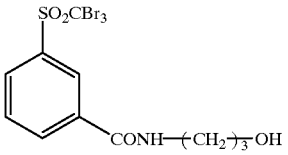

(P-2)

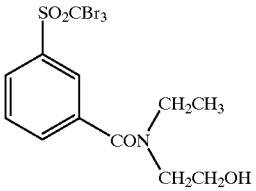

(P-3)

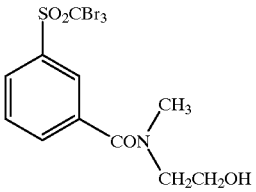

(P-4)

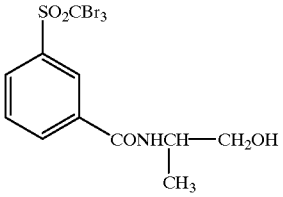

-continued (P-5)

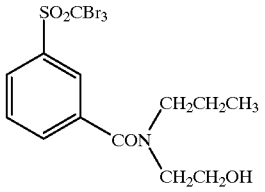

(P-6)

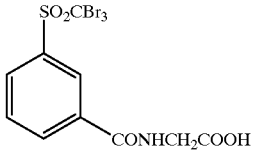

(P-7)

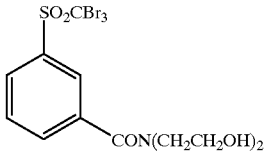

(P-8)

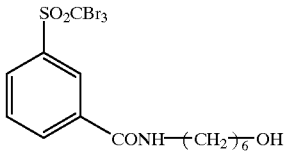

(P-9)

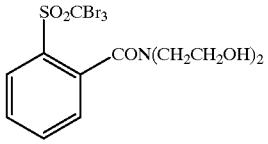

(P-10)

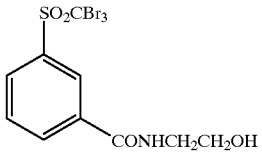

(P-11)

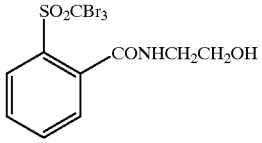

(P-12)

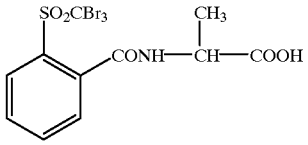

(P-13)

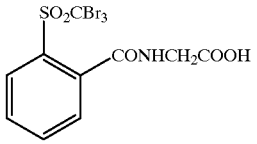

-continued
(P-14)
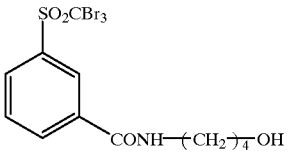
(P-15)
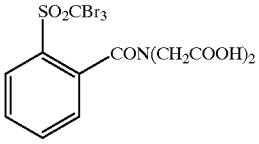
(P-16)
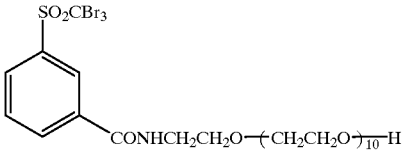
(P-17)
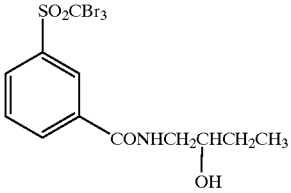
(P-18)
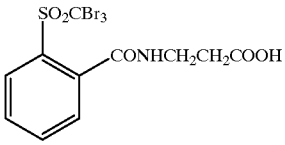
(P-19)
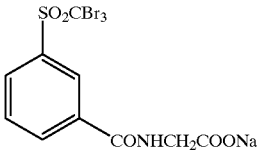
(P-20)
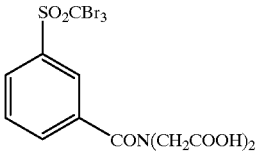
(P-21)
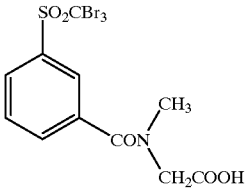
-continued
(P-22)
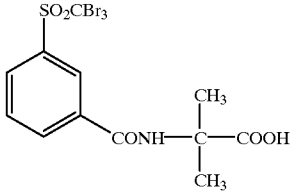
(P-23)
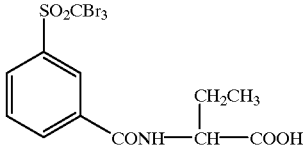
(P-24)
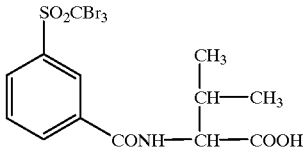
(P-25)
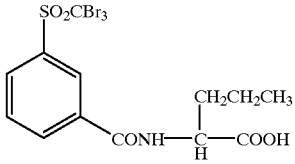
(P-26)
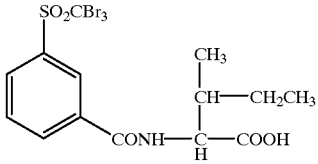
(P-27)
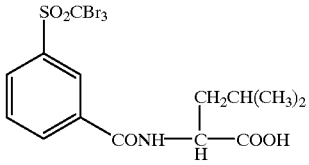
(P-28)
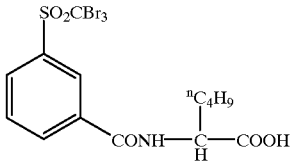
(P-29)
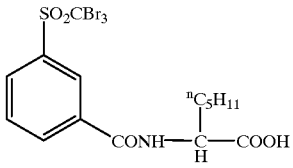

-continued
(P-30)
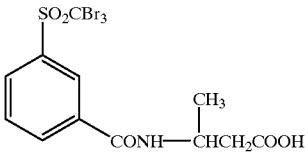
(P-31)
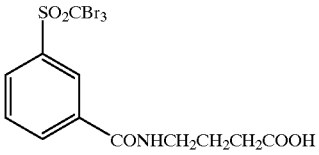
(P-32)
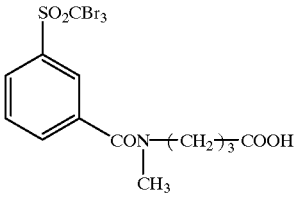
(P-33)
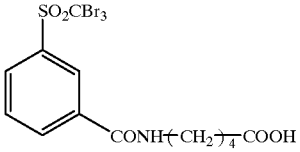
(P-34)
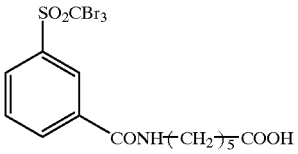
(P-35)
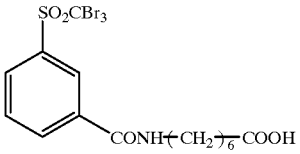
(P-36)
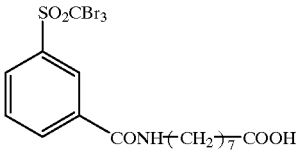
(P-37)
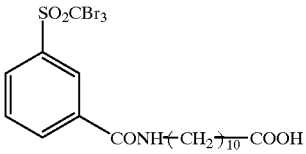
(P-38)
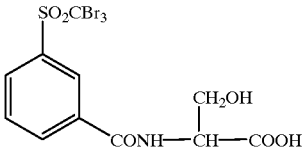
-continued
(P-39)
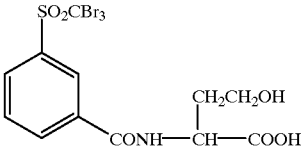
(P-40)
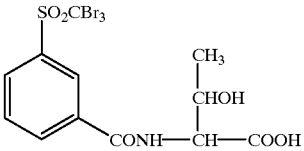
(P-41)
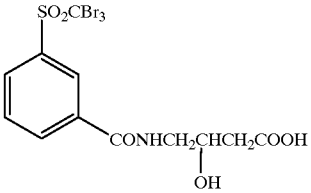
(P-42)
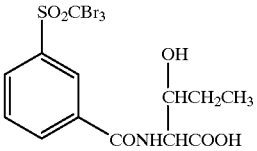
(P-43)
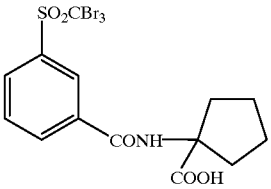
(P-44)
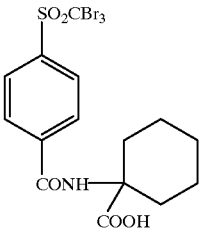
(P-45)
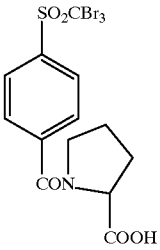

-continued
(P-46)
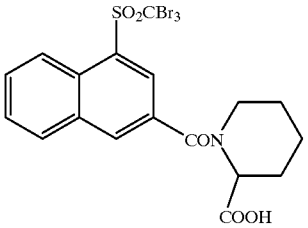
(P-47)
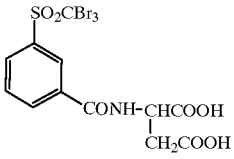
(P-48)
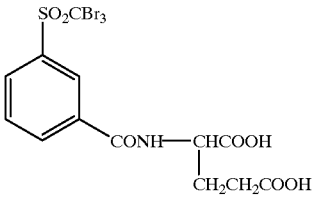
(P-49)
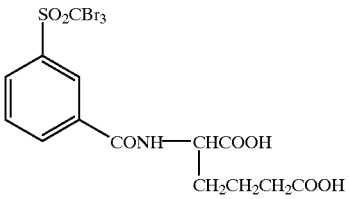
(P-50)
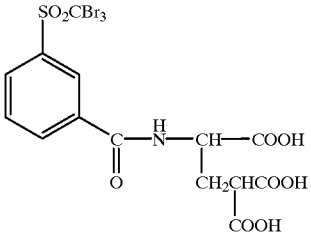
(P-51)
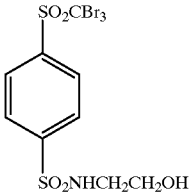
(P-52)
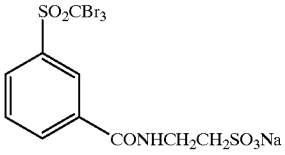
-continued
(P-53)
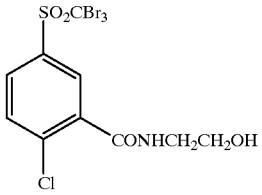
(P-54)
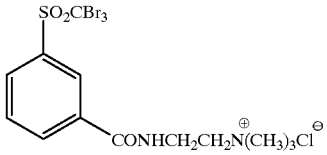
(P-55)
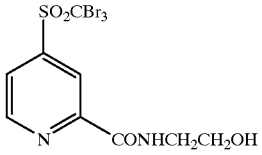
(P-56)
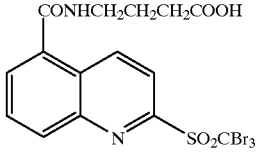
(P-57)
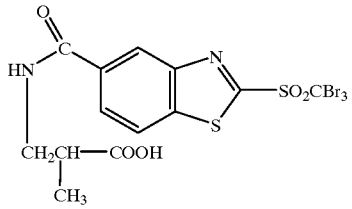
(P-58)
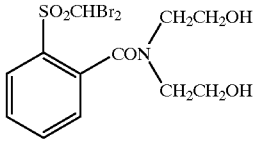
(P-59)
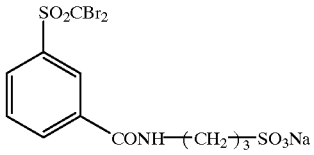
(P-60)
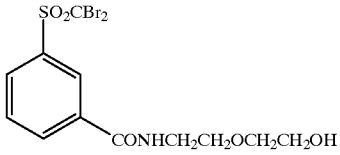

-continued (P-61)

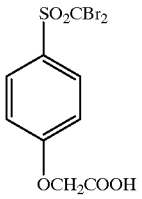

(P-62)

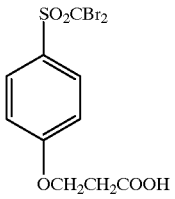

(P-63)

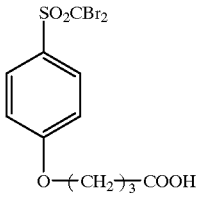

(P-64)

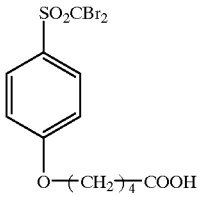

(P-65)

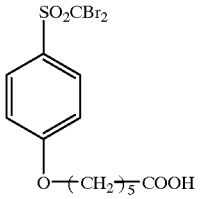

(P-66)

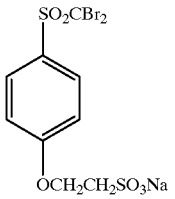

(P-67)

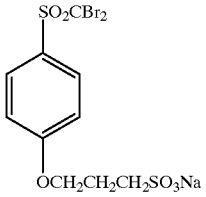

-continued (P-68)

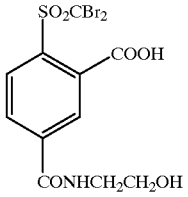

(P-69)

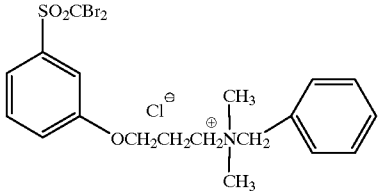

(P-70)

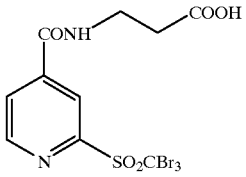

(P-71)

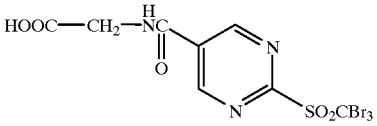

(P-72)

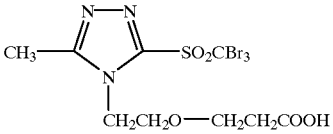

(P-73)

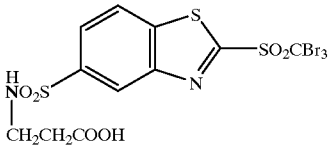

The compounds of the present invention can readily be synthesized through ordinary synthesis reactions. Typical synthetic methods will be explained below.

SYNTHETIC EXAMPLE 1

Synthesis of Exemplary Compound (P-7)

(1) Synthesis of Intermediate Compound (B)

Known and readily available Compound (A) (93 g), sodium hydroxide (43 g), sodium chloroacetate (123 g) and potassium iodide (10 g) were dissolved in water (300 ml), and stirred at 80° C. for 2 hours. After the internal temperature was lowered to 30° C., the reaction mixture was added with concentrated hydrochloric acid (50 ml). After the reaction mixture was stirred for a while, crystals were deposited. The crystals were collected by suction filtration and then dried to obtain 80 g of Intermediate compound (B) as white crystals.

(2) Synthesis of Intermediate Compound (C)

To a solution of NaOH (57 g) in water (500 ml), bromine (33 ml) was added dropwise at room temperature, and then an aqueous solution of Intermediate compound (B) (24 g) and NaOH (8 g) in water (100 ml) was added dropwise at room temperature. The deposited crystals were collected by filtration, and the obtained crystals were added to diluted hydrochloric acid and then filtered. The crystals were well washed with water and then dried. As a result, 30 g of Intermediate compound (C) was obtained as white crystals.

(3) Synthesis of Intermediate Compound (D)

The Intermediate compound (C) (30 g) and DMF (dimethylformamide, 1 ml) were dissolved in thionyl chloride (100 ml) and stirred at 70° C. for 30 minutes. Then, excessive thionyl chloride was evaporated under reduced pressure. As a result, 31 g of Intermediate compound (D) was obtained as white crystals.

(4) Synthesis of Exemplary Compound (P-7)

A solution of diethanolamine (4.7 g) in methanol (50 ml) was cooled on ice, and added with Intermediate compound (D) (4.1 g). After the mixture was stirred for 5 minutes, 50 ml of water was added to the mixture. As a result, white crystals were deposited. The crystals were collected by filtration and dissolved in a small amount of DMAc (dimethylacetamide), and the solution was added with methanol little by little to deposit crystals. These crystals were collected by filtration and dried to obtain 4.0 g of Exemplary compound (P-7) as white crystals.

SYNTHESIS EXAMPLE 2

Synthesis of Exemplary Compound (P-6)

Intermediate compound (D) (20 g) was added to a solution of glycine (15 g), $NaHCO_3$ (17 g), water (100 ml) and THF (tetrahydrofuran, 100 ml), and the mixture was stirred for 5 minutes at room temperature. The reaction mixture was neutralized by adding diluted hydrochloric acid. The mixture was added with water (200 ml) and then the deposited crystals were collected by filtration. The obtained crude crystals were dissolved in a small amount of DMAc, and added with methanol until crystals were deposited. The crystals were collected by filtration and dried to obtain 22 g of Exemplary compound (P-6) as white crystals.

Compound (A)

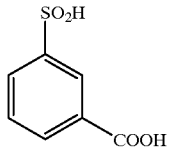

Intermediate (B)

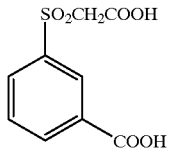

Intermediate (C)

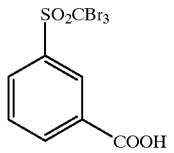

-continued

Intermediate (D)

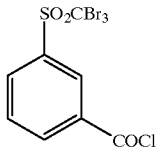

The compounds represented by the formula (1) of the present invention may be used by dissolving said compound in water or a suitable organic solvent, for example, alcohols such as methanol, ethanol, propanol, and fluorinated alcohol, ketones such as acetone, methyl ethyl ketone, and methyl isobutyl ketone, dimethylformamide, dimethyl sulfoxide, methyl cellosolve and the like. The compounds bound with one or more acidic groups may be neutralized with an equimolar alkaline and then added as an salt thereof.

The compounds may also be used as an emulsified dispersion mechanically prepared according to an already well known emulsification dispersion method by using an oil such as dibutyl phthalate, tricresyl phosphate, glyceryl triacetate or diethyl phthalate, or an auxiliary solvent such as ethyl acetate or cyclohexanone. Alternatively, the compounds may be used after dispersion of a powder in water by using a ball mill, a colloid mill, a sand grinder mil, MANTON GAULIN, a microfluidizer, or by means of ultrasonic wave according to a known method for solid dispersion.

The compounds represented by the formula (1) of the present invention may be added to any layers on a support provided at the side of the image-forming layer, i.e., the image-forming layer and/or one or more of the other layers provided on the same side. The compounds may preferably be added to the image-forming layer and one or more layers adjacent thereto.

The amount of the compounds represented by the formula (1) of the present invention may preferably $1\times10^{-6}$ to $1\times10^{-2}$ mol/m$^2$, more preferably $1\times10^{-5}$ to $5\times10^{-3}$ mol/m$^2$ based on application amount per 1 m$^2$ of the photosensitive material. They may be used alone or in any combination.

The heat-developable photographic material of the present invention may preferably contain, as an ultrahigh contrast agent, one or more substituted alkene derivatives, substituted isooxazole derivatives, and specific acetal compounds represented by the following formulas (2) to (4), respectively, which will be explained below.

Formula (2)

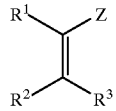

Formula (3)

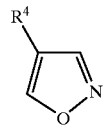

Formula (4)

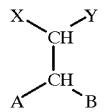

In the formula (2), $R^1$, $R^2$ and $R^3$ independently represent a hydrogen atom or a functional group, and Z represents an electron withdrawing group or a silyl group. $R^1$ together with Z, $R^2$ together with $R^3$, $R^1$ together with $R^2$, or $R^3$ together with Z may combine with each other to form a ring structure. In the formula (3), $R^4$ represents a functional group; and in the formula (4), X and Y independently represent a hydrogen atom or a functional group, A and B independently represent an alkoxyl group, an alkylthio group, an alkylamino group, an aryloxy group, an arylthio group, an anilino group, a heterocyclyloxy group, a heterocyclylthio group or a heterocyclylamino group, and X together with Y, or A together with B may be combined with each other to form a ring structure.

The compound represented by the formula (2) will be explained in detail below.

In the formula (2), $R^1$, $R^2$ and $R^3$ independently represent a hydrogen atom or a functional group, and Z represents an electron withdrawing group or a silyl group. In the formula (2), $R^1$ together with Z, $R^2$ together with $R^3$, $R^1$ together with $R^2$, or $R^3$ together with Z may combine with each other to form a ring structure.

When $R^1$, $R^2$ or $R^3$ represents a functional group, examples of the functional group include a halogen atom (e.g., fluorine, chlorine, bromide, iodine), an alkyl group (including an aralkyl group, a cycloalkyl group and active methine group), an alkenyl group, an alkynyl group, an aryl group, a heterocyclic group (including N-substituted nitrogen-containing heterocyclic group), a quaternized nitrogen-containing heterocyclic group (e.g., pyridinio group), an acyl group, an alkoxycarbonyl group, an aryloxycarbonyl group, a carbamoyl group, carboxyl group or a salt thereof, an imino group, an imino group substituted at N atom, a thiocarbonyl group, a sulfonylcarbamoyl group, an acylcarbamoyl group, a sulfamoylcarbamoyl group, a carbazoyl group, an oxalyl group, an oxamoyl group, cyano group, a thiocarbamoyl group, hydroxyl group (or a salt thereof), an alkoxyl group (including groups containing repeating units of ethyleneoxy group or propyleneoxy group), an aryloxy group, a heterocyclyloxy group, an acyloxy group, an (alkoxyl or aryloxy)carbonyloxy group, a carbamoyloxy group, a sulfonyloxy group, an amino group, an (alkyl, aryl or heterocyclic)amino group, an acylamino group, a sulfonamido group, a ureido group, a thioureido group, an imido group, an (alkoxyl or aryloxy) carbonylamino group, a sulfamoylamino group, a semicarbazide group, a thiosemicarbazide group, a hydrazino group, a quaternary ammonio group, an oxamoylamino group, an (alkyl or aryl)sulfonylureido group, an acylureido group, an acylsulfamoylamino group, nitro group, mercapto group, an (alkyl, aryl or heterocyclic)thio group, an acylthio group, an (alkyl or aryl)sulfonyl group, an (alkyl or aryl)sulfinyl group, sulfo group or a salt thereof, a sulfamoyl group, an acylsulfamoyl group, a sulfonylsulfamoyl group or a salt thereof, a phosphoryl group, a group containing phosphoramide or phosphoric acid ester structure, a silyl group and a stannyl group.

These functional groups may further be substituted with any one or more of the above-described functional groups.

The electron withdrawing group represented by Z in the formula (2) is a functional group that gives a positive value of the Hammett's substituent constant $\sigma$ p, and specific examples include cyano group, an alkoxycarbonyl group, an aryloxycarbonyl group, a carbamoyl group, an imino group, an imino group substituted at N atom, a thiocarbonyl group, a sulfamoyl group, an alkylsulfonyl group, an arylsulfonyl group, nitro group, a halogen atom, a perfluoroalkyl group, a perfluoroalkanamido group, a sulfonamido group, an acyl group, a formyl group, a phosphoryl group, carboxyl group (or a salt thereof), sulfo group (or a salt thereof), a heterocyclic group, an alkenyl group, an alkynyl group, an acyloxy group, an acylthio group, a sulfonyloxy group, and an aryl group substituted with one or more of the above-described electron withdrawing groups. The heterocyclic group mentioned above is a saturated or unsaturated heterocyclic group, and examples include a pyridyl group, a quinolyl group, a quinoxalinyl group, a pyrazinyl group, a benzotriazolyl group, an imidazolyl group, a benzimidazolyl group, a hydantoin-1-yl group, a succinimido group and a phthalimido group.

The electron withdrawing group represented by Z in the formula (2) may further have one or more functional groups, and examples of the functional groups include those described as the functional group represented by $R^1$, $R^2$ or $R^3$ in the formula (2).

In the formula (2), $R^1$ together with Z, $R^2$ together with $R^3$, $R^1$ together with $R^2$, or $R^3$ together with Z may combine with each other to form a ring structure. The ring structure formed is a non-aromatic carbocyclic ring or a non-aromatic heterocyclic ring.

The preferred scope of the compound represented by the formula (2) will be described below.

The silyl group represented by Z in the formula (2) may preferably be trimethylsilyl group, t-butyldimethylsilyl group, phenyldimethylsilyl group, triethylsilyl group, triisopropylsilyl group or trimethylsilyldimethylsilyl group.

The electron withdrawing group represented by Z in the formula (2) may preferably be a group having a total carbon atom number of from 0 to 30 such as cyano group, an alkoxycarbonyl group, an aryloxycarbonyl group, a carbamoyl group, a thiocarbonyl group, an imino group, an imino group substituted at N atom, a sulfamoyl group, an alkylsulfonyl group, an arylsulfonyl group, nitro group, a perfluoroalkyl group, an acyl group, a formyl group, a phosphoryl group, an acyloxy group, an acylthio group or a phenyl group substituted with one or more electron withdrawing groups, more preferably cyano group, an alkoxycarbonyl group, a carbamoyl group, an imino group, a sulfamoyl group, an alkylsulfonyl group, an arylsulfonyl group, an acyl group, formyl group, phosphoryl group, trifluoromethyl group, or a phenyl group substituted with one or more electron withdrawing groups, and most preferably cyano group, formyl group, an acyl group, an alkoxycarbonyl group, imino group, or carbamoyl group.

The group represented by Z in the formula (2) is preferably an electron withdrawing group.

The functional group represented by $R^1$, $R^2$ or $R^3$ in the formula (2) may preferably be a group having a total carbon atom number of from 0 to 30, and specific examples of the group include the same groups as those explained as the electron withdrawing group represented by Z in the formula (2), as well as an alkyl group, hydroxyl group (or a salt thereof), mercapto group (or a salt thereof), an alkoxyl group, an aryloxy group, a heterocyclyloxy group, an alkylthio group, an arylthio group, a heterocyclylthio group, an amino group, an alkylamino group, an arylamino group, a heterocyclylamino group, a ureido group, an acylamino group, a sulfonamido group and a substituted or unsubstituted aryl group and the like.

In the formula (2), $R^1$ is preferably an electron withdrawing group, an aryl group, an alkylthio group, an alkoxyl group, an acylamino group, hydrogen atom, or a silyl group.

When $R^1$ represents an electron withdrawing group, the electron withdrawing group may preferably be a group having a total carbon atom number of from 0 to 30 such as cyano group, nitro group, an acyl group, formyl group, an alkoxycarbonyl group, an aryloxycarbonyl group, a thiocarbonyl group, an imino group, an imino group substituted at N atom, an alkylsulfonyl group, an arylsulfonyl group, a carbamoyl group, a sulfamoyl group, a trifluoromethyl group, a phosphoryl group, carboxyl group (or a salt thereof), a saturated or unsaturated heterocyclic group, more preferably cyano group, an acyl group, formyl group, an alkoxycarbonyl group, a carbamoyl group, imino group, an imino group substituted at N atom, sulfamoyl group, carboxyl group (or a salt thereof) or a saturated or unsaturated heterocyclic group, and most preferably cyano group, a formyl group, an acyl group, an alkoxycarbonyl group, carbamoyl group, or a saturated or unsaturated heterocyclic group.

When $R^1$ represents an aryl group, the aryl group is preferably a substituted or unsubstituted phenyl group having a total carbon atom number of from 6 to 30. The functional group may be any functional group, and an electron withdrawing functional group is preferred.

In the formula (2), $R^1$ is more preferably an electron withdrawing group or an aryl group.

The functional group represented by $R^2$ or $R^3$ in the formula (2) may preferably be the same group as those explained as the electron withdrawing group represented by Z in the formula (2), as well as an alkyl group, hydroxyl group (or a salt thereof), mercapto group (or a salt thereof), an alkoxyl group, an aryloxy group, a heterocyclyloxy group, an alkylthio group, an arylthio group, a heterocyclylthio group, an amino group, an alkylamino group, an anilino group, a heterocyclylamino group, an acylamino group or a substituted or unsubstituted phenyl group.

In the formula (2), it is more preferred that one of $R^2$ and $R^3$ is hydrogen atom and the other is a functional group. The functional group may preferably be an alkyl group, hydroxyl group (or a salt thereof), mercapto group (or a salt thereof), an alkoxyl group, an aryloxy group, a heterocyclyloxy group, an alkylthio group, an arylthio group, a heterocyclylthio group, an amino group, an alkylamino group, an anilino group, a heterocyclylamino group, an acylamino group (particularly, a perfluoroalkanamido group), a sulfonamido group, a substituted or unsubstituted phenyl group or a heterocyclic group, more preferably hydroxyl group (or a salt thereof), mercapto group (or a salt thereof, an alkoxyl group, an aryloxy group, a heterocyclyloxy group, an alkylthio group, an arylthio group, a heterocyclylthio group or a heterocyclic group, and most preferably hydroxyl group (or a salt thereof), an alkoxyl group or a heterocyclic group.

In the formula (2), it is also preferred that Z together with $R^1$ or $R^2$ together with $R^3$ form a ring structure. The ring structure formed is a non-aromatic carbocyclic ring or a non-aromatic heterocyclic ring, preferably a 5- to 7-membered ring structure having a total carbon atom number of from 1 to 40, more preferably from 3 to 30 including those of its functional groups.

The compound represented by the formula (2) is more preferably a compound wherein Z represents cyano group, a formyl group, an acyl group, an alkoxycarbonyl group, an imino group or a carbamoyl group; $R^1$ represents an electron withdrawing group or an aryl group, and one of $R^2$ and $R^3$ represents hydrogen atom and the other represents hydroxyl group (or a salt thereof), mercapto group (or a salt thereof), an alkoxyl group, an aryloxy group, a heterocyclyloxy group, an alkylthio group, an arylthio group, a heterocyclylthio group or a heterocyclic group.

A class of most preferable compounds represented by the formula (2) are those wherein Z and $R^1$ form a non-aromatic 5- to 7-membered ring structure, and one of $R^2$ and $R^3$ represents hydrogen atom and the other represents hydroxyl group (or a salt thereof), mercapto group (or a salt thereof), an alkoxyl group, an aryloxy group, a heterocyclyloxy group, an alkylthio group, an arylthio group, a heterocyclylthio group or a heterocyclic group. Z that forms a non-aromatic ring structure together with $R^1$ is preferably an acyl group, a carbamoyl group, an oxycarbonyl group, a thiocarbonyl group or a sulfonyl group, and $R^1$ is preferably an acyl group, a carbamoyl group, an oxycarbonyl group, a thiocarbonyl group, a sulfonyl group, an imino group, an imino group substituted at N atom, an acylamino group or a carbonylthio group.

The compound represented by the formula (3) will be described below.

In the formula (3), examples of the functional group represented by $R^4$ include those explained as the functional group represented by $R^1$, $R^2$ or $R^3$ in the formula (2).

The functional group represented by $R^4$ in the formula (3) may preferably be an electron withdrawing group or an aryl group. Where $R^4$ represents an electron withdrawing group, the electron withdrawing group may preferably be a group having a total carbon atom number of from 0 to 30, such as cyano group, nitro group, an acyl group, a formyl group, an alkoxycarbonyl group, an aryloxycarbonyl group, an alkylsulfonyl group, an arylsulfonyl group, a carbamoyl group, a sulfamoyl group, a trifluoromethyl group, a phosphoryl group, an imino group or a saturated or unsaturated heterocyclic group, more preferably cyano group, an acyl group, a formyl group, an alkoxycarbonyl group, a carbamoyl group, a sulfamoyl group, an alkylsulfonyl group, an arylsulfonyl group or a heterocyclic group, and most preferably cyano group, a formyl group, an acyl group, an alkoxycarbonyl group, a carbamoyl group or a heterocyclic group.

Where $R^4$ represents an aryl group, the aryl group may preferably be a substituted or unsubstituted phenyl group having a total carbon atom number of from 0 to 30. Examples of the functional group include those described as the functional group represented by $R^1$, $R^2$ or $R^3$ in the formula (2).

$R^4$ in the formula (3) is most preferably cyano group, an alkoxycarbonyl group, a carbamoyl group, a heterocyclic group or a substituted or unsubstituted phenyl group, and most preferably cyano group, a heterocyclic group or an alkoxycarbonyl group.

The compound represented by the formula (4) will be described in detail below.

In the formula (4), X and Y independently represent hydrogen atom or a functional group, and A and B independently represent an alkoxyl group, an alkylthio group, an alkylamino group, an aryloxy group, an arylthio group, an anilino group, a heterocyclylthio group, a heterocyclyloxy group or a heterocyclylamino group, and X together with Y or A together with B may combine with each other to form a ring structure.

Examples of the functional group represented by X or Y in the formula (4) include those described as the functional group represented by $R^1$, $R^2$ or $R^3$ in the formula (2). Specific examples include an alkyl group (including a perfluoroalkyl group and a trichloromethyl group), an aryl group, a heterocyclic group, a halogen atom, cyano group, nitro group, an alkenyl group, an alkynyl group, an acyl group, formyl group, an alkoxycarbonyl group, an aryloxycarbonyl group, imino group, an imino group substituted at the nitrogen atom, carbamoyl group, thiocarbonyl group, an acyloxy group, an acylthio group, an acylamino group, an alkylsulfonyl group, an arylsulfonyl group, a sulfamoyl group, a phosphoryl group, carboxyl group (or a salt thereof), sulfo group (or a salt thereof), hydroxyl group (or a salt thereof), mercapto group (or a salt thereof), an alkoxyl group, an aryloxy group, a heterocyclyloxy group, an alkylthio group, an arylthio group, a heterocyclylthio group, an amino group, an alkylamino group, an anilino group, a heterocyclylamino group, a silyl group and the like.

These groups may further have one or more functional groups. X together with Y may combine with each other to form a ring structure, and the ring structure formed may be either a non-aromatic carbocyclic ring or a non-aromatic heterocyclic ring.

In the formula (4), the functional group represented by X or Y may preferably be a functional group having a total carbon number of from 1 to 40, more preferably from 1 to 30, such as cyano group, an alkoxycarbonyl group, an aryloxycarbonyl group, carbamoyl group, imino group, an imino group substituted at the nitrogen atom, thiocarbonyl group, sulfamoyl group, an alkylsulfonyl group, an arylsulfonyl group, nitro group, a perfluoroalkyl group, an acyl group, formyl group, a phosphoryl group, an acylamino group, an acyloxy group, an acylthio group, a heterocyclic group, an alkylthio group, an alkoxyl group or an aryl group.

In the formula (4), X and Y are more preferably cyano group, nitro group, an alkoxycarbonyl group, carbamoyl group, an acyl group, formyl group, an acylthio group, an acylamino group, thiocarbonyl group, sulfamoyl group, an alkylsulfonyl group, an arylsulfonyl group, imino group, an imino group substituted at the nitrogen atom, a phosphoryl group, a trifluoromethyl group, a heterocyclic group , a substituted phenyl group or the like, and most preferably cyano group, an alkoxycarbonyl group, a carbamoyl group, an alkylsulfonyl group, an arylsulfonyl group, an acyl group, an acylthio group, an acylamino group, a thiocarbonyl group, formyl group, imino group, an imino group substituted at the nitrogen atom, a heterocyclic group a phenyl group substituted by any electron withdrawing group or the like.

X and Y may also preferably combine with each other to form a non-aromatic carbocyclic ring or a non-aromatic heterocyclic ring. The ring structure formed may preferably be a 5- to 7-membered ring having a total carbon atom number of from 1 to 40, more preferably from 3 to 30. X and Y for forming the ring structure may preferably be an acyl group, a carbamoyl group, an oxycarbonyl group, a thiocarbonyl group, a sulfonyl group, imino group, an imino group substituted at the nitrogen atom, an acylamino group, a carbonylthio group or the like.

In the formula (4), A and B independently represent an alkoxyl group, an alkylthio group, an alkylamino group, an aryloxy group, an arylthio group, an anilino group, a heterocyclylthio group, a heterocyclyloxy group or a heterocyclylamino group, which may combine with each other to form a ring structure.

The functional groups represented by A and B in the formula (4) may preferably be a group having a total carbon atom number of from 1 to 40, more preferably from 1 to 30, and the group may further have one or more functional groups.

In the formula (4), A and B more preferably combine with each other to form a ring structure. The ring structure formed may preferably be a 5- to 7-membered non-aromatic heterocyclic ring having a total carbon atom number of from 1 to 40, more preferably from 3 to 30. Examples of —A—B— that is formed by the linking of A and B include, for example, —O—$(CH_2)$2—O—, —O—$(CH_2)_3$—O—, —S—$(CH_2)_2$—S—, —S—$(CH_2)_3$—S—, —S—Ph—S—, —N$(CH_3)$—$(CH_2)_2$—O—, —N$(CH_3)$—$(CH_2)_2$—S—, —O—$(CH_2)_2$—S—, —O—$(CH_2)_3$—S—, —N$(CH_3)$—Ph—O—, —N$(CH_3)$—Ph—S—, —N(Ph)—$(CH_2)_2$—S— and the like.

The compound represented by the formula (2), (3) or (4) for use in the present invention may be introduced with an group capable of being adsorbed to silver halide. Examples of the adsorbable group include the groups described in U.S. Pat. Nos. 4,385,108 and 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244, JP-A-63-234245 and JP-A-63-234246, such as an alkylthio group, an arylthio group, a thiourea group, a thioamide group, a mercaptoheterocyclic group and a triazole group. The adsorbable group to silver halide may be formed as a precursor. Examples of the precursor include the groups described in JP-A-2-285344.

The compound represented by the formula (2), (3) or (4) for use in the present invention may be introduced with a ballast group or a polymer commonly used in the field of immobile photographic additives such as a coupler. The compounds incorporated with the ballast group may be preferred for the present invention. The ballast group is a group having 8 or more carbon atoms and being relatively inactive in the photographic performance. The ballast group may be chosen from an alkyl group, an aralkyl group, an alkoxyl group, a phenyl group, an alkylphenyl group, a phenoxy group, an alkylphenoxy group and the like. Examples of the polymer include those described in JP-A-1-100530 and the like.

The compound represented by the formula (2), (3) or (4) for use in the present invention may contain a cationic group (specifically, a group containing a quaternary ammonio group or a nitrogen-containing heterocyclic group containing a quaternized nitrogen atom), a group containing an ethyleneoxy group or a propyleneoxy group as a repeating unit, an (alkyl, aryl or heterocyclic)thio group, or a dissociative group capable of dissociation by a base (e.g., carboxyl group, sulfo group, an acylsulfamoyl group, a carbamoylsulfamoyl group). In particular, a group containing an ethyleneoxy group or a propyleneoxy group as a repeating unit, or an (alkyl, aryl or heterocyclic)thio group are preferred for the present invention. Specific examples of these groups include the compounds described in JP-A-7-234471, JP-A-5-333466, JP-A-6-19032, JP-A-6-19031, JP-A-5-45761, U.S. Pat. Nos. 4,994,365 and 4,988,604, JP-A-3-259240, JP-A-7-5610, JP-A-7-244348 and German Patent No. 4,006,032.

Specific examples of the compounds represented by the formulas (2) to (4) for use in the present invention are shown below. However, the scope of the present invention is not limited to the following compounds.

B-1

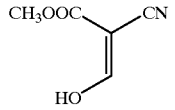

-continued
B-2
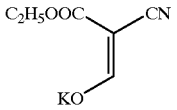
B-3
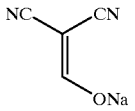
B-4
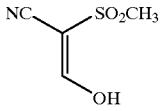
B-5
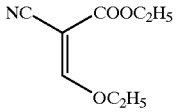
B-6
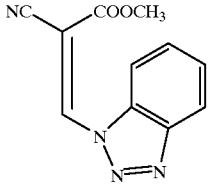
B-7
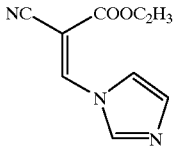
B-8
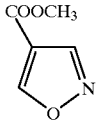
B-9
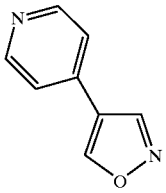
B-10
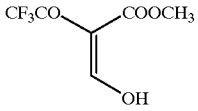
B-11
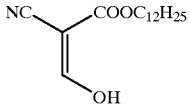
-continued
B-12
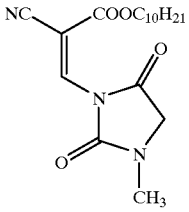
B-13
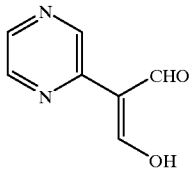
B-14
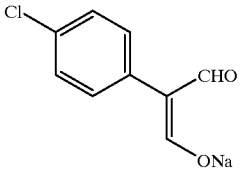
B-15
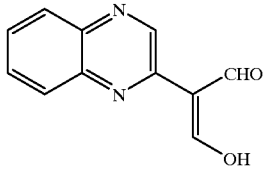
B-16
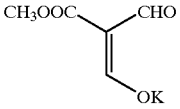
B-17
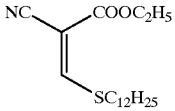
B-18
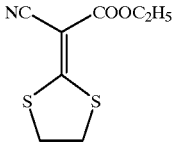
B-19
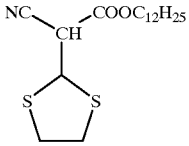
B-20
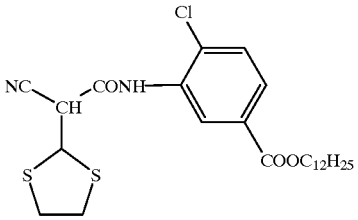

-continued
B-21
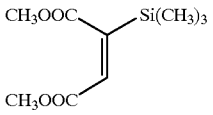
B-22
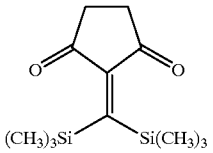
B-23
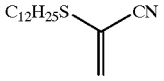
B-24
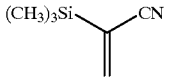
B-25
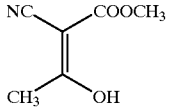
B-26
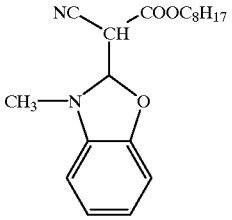
B-27
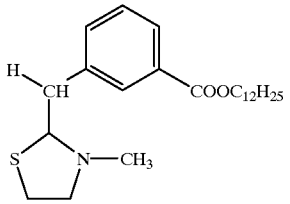
B-28
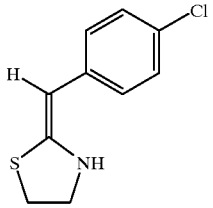
B-29
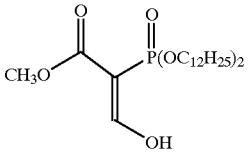
B-30
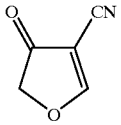
-continued
B-31
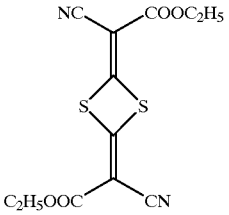
B-32
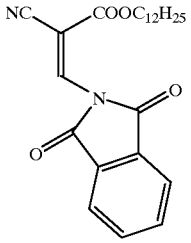
B-33
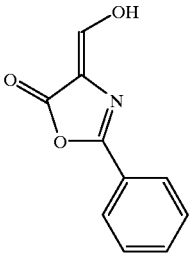
B-34
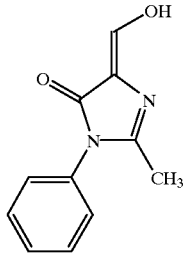
B-35
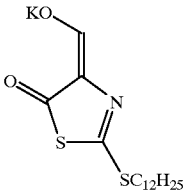
B-36
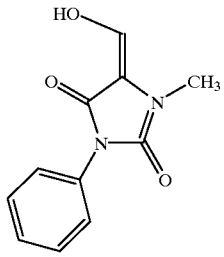

-continued
B-37
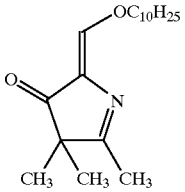
B-38
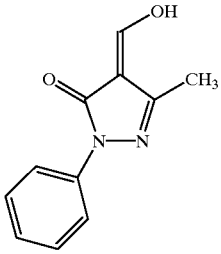
B-39
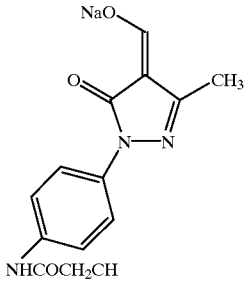
B-40
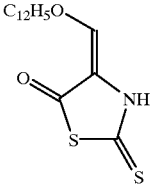
B-41
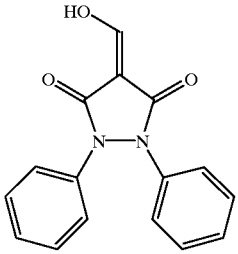
B-42
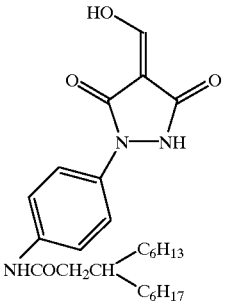
-continued
B-43
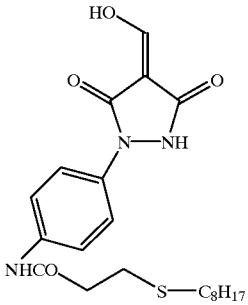
B-44
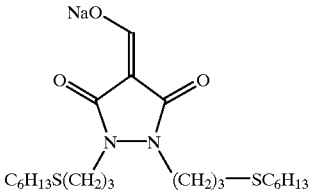
B-45
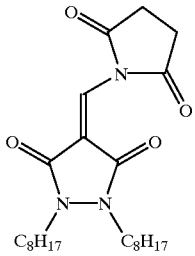
B-46
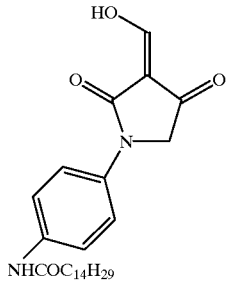
B-47
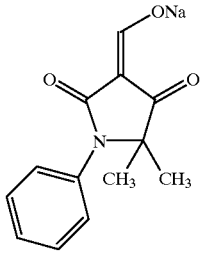

B-48
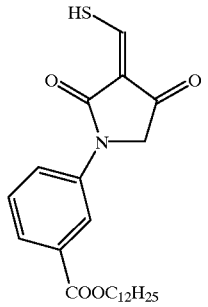
B-49
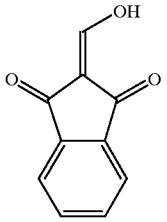
B-50
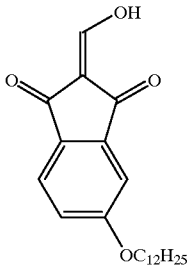
B-51
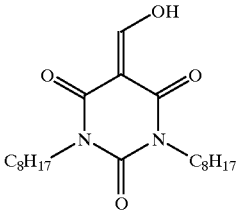
B-52
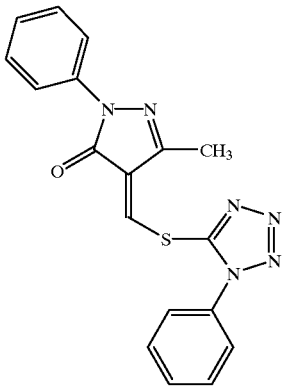
B-53
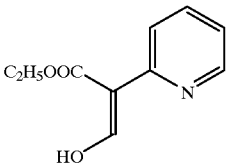
B-54
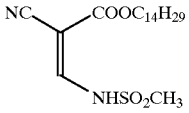
B-55
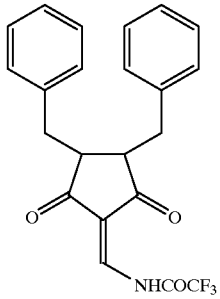
B-56
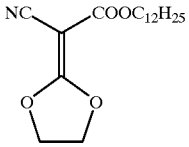
B-57
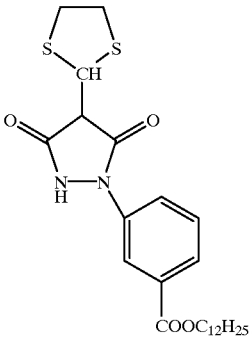
B-58
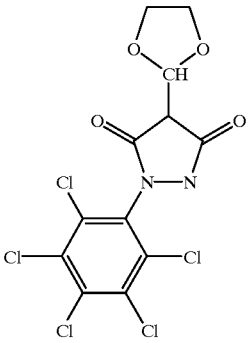

-continued

B-59

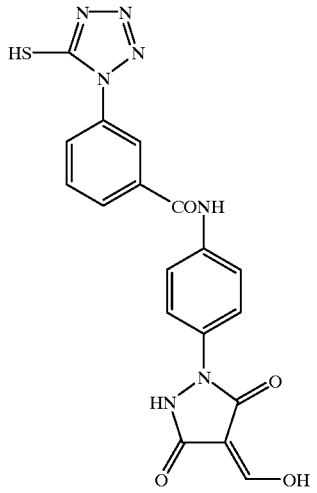

B-60

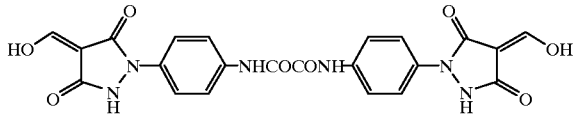

The compounds represented by the formulas (2) to (4) for use in the present invention may be used after being dissolved in water or an appropriate organic solvent such as an alcohol (e.g., methanol, ethanol, propanol, fluorinated alcohol), a ketone (e.g., acetone, methyl ethyl ketone), dimethylformamide, dimethyl sulfoxide or methyl cellosolve.

The compounds may also be used as an emulsified dispersion mechanically prepared according to an already well known emulsification dispersion method by using an oil such as dibutyl phthalate, tricresyl phosphate, glyceryl triacetate or diethyl phthalate, an auxiliary solvent such as ethyl acetate or cyclohexanone. Alternatively, the compounds may be used after dispersion of a powder in water by using a ball mill, a colloid mill, a sand grinder mil, MANTON GAUILIN, a microfluidizer, or by means of ultrasonic wave according to a known method for solid dispersion.

The compounds represented by the formulas (2) to (4) for use in the present invention may be added to one or more layers on a support provided at the side of the image-forming layer, i.e., the image-forming layer and/or one or more of the other layers provided on the same side. The compounds may preferably be added to the image-forming layer and one or more layer adjacent thereto.

The amount of the compounds represented by the formulas (2) to (4) for use in the present invention is preferably from $1\times10^{-6}$ to 1 mole, more preferably from $1\times10^{-5}$ to $5\times10^{-1}$ mole, most preferably from $2\times10^{-5}$ to $2\times10^{-1}$ mole based on one mol silver.

The compounds represented by formulas (2) to (4) can be easily synthesized according to known methods. For example, the compounds may be synthesized by referring to the methods described in U.S. Pat. Nos. 5,545,515, 5,635,339 and 5,654,130, International Patent Publication WO97/34196 or Japanese Patent Application Nos. 9-354107, 9-309813 and 9-272002.

The compounds represented by the formulas (2) to (4) for use in the present invention may be used alone or in combination of two or more compounds. In addition, any of the compounds described in U.S. Pat. Nos. 5,545,515, 5,635,339 and 5,654,130, International Patent Publication WO97/34196, U.S. Pat. No. 5,686,228 or Japanese Patent Application Nos. 8-279962, 9-228881, 9-273935, 9-354107, 9-309813, 9-296174, 9-282564, 9-272002, 9-272003 and 9-332388 may be used in combination with the compounds of formulas (2) to (4).

The hydrazine derivatives disclosed in Japanese Patent Application Nos. 9-166628, 8-279957 and 9-240511 may be used additionally according to the present invention. In addition, the following hydrazine derivatives may also be used additionally: the compounds represented by (Chemical Formula 1) of JP-B-6-77138, specifically, compounds described at pages 3 and 4 of the publication; the compounds represented by the formula (I) of JP-B-6-93082, specifically, Compounds 1 to 38 described at pages 8 to 18 of the publication; the compounds represented by the formulas (4), (5) and (6) of JP-A-6-230497, specifically, Compounds 4-1 to 4-10 described at pages 25 and 26, Compounds 5-1 to 5-42 described at pages 28 to 36 and Compounds 6-1 to 6-7 described at pages 39 and 40 of the publication; the compounds represented by the formulas (1) and (2) of JP-A-6-289520, specifically, Compounds 1-1) to 1-17) and 2-1) described at pages 5 to 7 of the publication; the compounds represented by (Chemical Formula 2) and (Chemical Formula 3) of JP-A-6-313936, specifically, compounds described at pages 6 to 19 of the publication; the compound represented by (Chemical Formula 1) of JP-A-6-313951, specifically, the compounds described at pages 3 to 5 of the publication; the compound represented by the formula (I) of JP-A-7-5610, specifically, Compounds I-1 to I-38 described at pages 5 to 10 of the publication; the compounds represented by the formula (II) of JP-A-7-77783, specifically, Compounds II-1 to II-102 described at pages 10 to 27 of the publication; the compounds represented by the formulas (H) and (Ha) of JP-A-7-104426, specifically, Compounds H-1 to H-44 described at pages 8 to 15 of the publication; the compounds characterized by having in the vicinity of the hydrazine group an anionic group or a nonionic group capable of forming an intramolecular hydrogen bond with a hydrogen atom of hydrazine, described in EP713131A, particularly, the compounds represented by the formulas (A), (B), (C), (D), (E) and (F), specifically, Compounds N-1 to N-30 described in the publication; the compound represented by the formula (1) described in EP713131A, specifically, Compounds D-1 to D-55 described in the publication; various hydrazine derivatives described at pages 25 to 34 of Kochi Gijutsu (Known Techniques), pages 1 to 207, Aztech (issued on Mar. 22, 1991); and Compounds D-2 and D-39 described in JP-A-62-86354 (pages 6 and 7).

These hydrazine derivatives may be used after being dissolved in an appropriate organic solvent such as an alcohol (e.g., methanol, ethanol, propanol, fluorinated alcohol), a ketone (e.g., acetone, methyl ethyl ketone), dimethylformamide, dimethyl sulfoxide or methyl cellosolve.

The compounds may also be used as an emulsified dispersion mechanically prepared according to an already well known emulsification dispersion method by using an oil such as dibutyl phthalate, tricresyl phosphate, glyceryl triacetate or diethyl phthalate, or an auxiliary solvent such as ethyl acetate or cyclohexanone. Alternatively, the compounds may be used after dispersion of a powder in water by using a ball mill, a colloid mill, a sand grinder mil, MANTON GAULIN, a microfluidizer, or by means of ultrasonic wave according to a known method for solid dispersion.

The hydrazine derivatives may be added to one or more layers on a support provided at the side of the image-forming layer, i.e., the image-forming layer and/or one or more of the other layers provided on the same side. The compounds may preferably be added to the image-forming layer and one or more layer adjacent thereto.

The amount of the hydrazine derivatives is preferably from $1\times10^{-6}$ to $1\times10^{-2}$ mole, more preferably from $1\times10^{-5}$ to $5\times10^{-3}$ mole, most preferably from $2\times10^{-5}$ to $5\times10^{-3}$ mole based on one mole of silver.

In addition, the acrylonitrile compounds disclosed in U.S. Pat. No. 5,545,515, more specifically the compounds CN-1 to CN-13 disclosed therein and the like may be used as the ultrahigh contrast agent.

In the present invention, a contrast accelerator may be used in combination with the above-described ultrahigh contrast agent for the formation of an ultrahigh contrast image. For example, amine compounds described in U.S. Pat. No. 5,545,505, specifically, AM-1 to AM-5; hydroxamic acids described in U.S. Pat. No. 5,545,507, specifically, HA-1 to HA-11; hydrazine compounds described in U.S. Pat. No. 5,558,983, specifically, CA-1 to CA-6; and onium salts described in JP-A-9-297368, specifically, A-1 to A-42, B-1 to B-27 and C-1 to C-14 may be used.

Preparation and addition of the aforementioned contrast accelerator as well as choosing of its amounts and the like may be conducted as those described in the patent publications cited above.

The heat-developable photographic material of the present invention contains a reducing agent for organic silver salt. The reducing agent for organic silver salt may be any substance, preferably an organic substance, which reduces the silver ion to metal silver. Conventional photographic developers such as phenidone, hydroquinone and catechol are useful. A hindered phenol reducing agent is preferred. The reducing agent is preferably contained in an amount of from 5 to 50% by mole, more preferably from 10 to 40% by mole based on per mole of silver on the surface having an image-forming layer. The layer to which the reducing agent is added may be any one or more of layers on the surface having an image-forming layer. Where the reducing agent is added to a layer other than the image-forming layer, the reducing agent is preferably used in a slightly large amount, i.e., from 10 to 50% by mole based on one mole of silver. The reducing agent may also be a so-called precursor that is modified so as to effectively exhibit the function only at the time of development.

For the heat-developable photographic material using an organic silver salt, variety of reducing agents are disclosed in JP-A-46-6074, JP-A-47-1238, JP-A-47-33621, JP-A-49-46427, JP-A-49-115540, JP-A-50-14334, JP-A-50-36110, JP-A-50-147711, JP-A-51-32632, JP-A-51-1023721, JP-A-51-32324, JP-A-51-51933, JP-A-52-84727, JP-A-55-108654, JP-A-56-146133, JP-A-57-82828, JP-A-57-82829, JP-A-6-3793, U.S. Pat. Nos. 3,667,9586, 3,679,426, 3,751,252, 3,751,255, 3,761,270, 3,782,949, 3,839,048, 3,928,686 and 5,464,738, German Patent No. 2,321,328, European Patent 692732 and the like. Examples include amidoximes such as phenylamidoxime, 2-thienylamidoxime and p-phenoxyphenylamidoxime; azines such as 4-hydroxy-3,5-dimethoxybenzaldehyde azine; combinations of an aliphatic carboxylic acid arylhydrazide with an ascorbic acid such as a combination of 2,2-bis(hydroxymethyl)propionyl-β-phenylhydrazine with an ascorbic acid; combinations of polyhydroxybenzene with hydroxylamine, reductone and/or hydrazine such as a combination of hydroquinone with bis(ethoxyethyl)hydroxylamine, piperidinohexose reductone or formyl-4-methylphenylhydrazine; hydroxamic acids such as phenylhydroxamic acid, p-hydroxyphenylhydroxamic acid and β-anilinehydroxamic acid; combinations of an azine with a sulfonamidophenol such as a combination of phenothiazine with 2,6-dichloro-4-benzenesulfonamidophenol; α-cyanophenylacetic acid derivatives such as ethyl-α-cyano-2-methylphenylacetate and ethyl-α-cyanophenylacetate; bis-β-naphthols such as 2,2'-dihydroxy-1,1'-binaphthyl, 6,6'-dibromo-2,2'-dihydroxy-1,1'-binaphthyl and bis(2-hydroxy-1-naphthyl) methane; combinations of a bis-β-naphthol with a 1,3-dihydroxybenzene derivative (e.g., 2,4-dihydroxybenzophenone, 2',4'-dihydroxyacetophenone); 5-pyrazolones such as 3-methyl-1-phenyl-5-pyrazolone; reductones such as dimethylaminohexose reductone, anhydrodihydroaminohexose reductone and anhydrodihydropiperidonehexose reductone; sulfonamidophenol reducing agents such as 2,6-dichloro-4-benzenesulfonamidophenol and p-benzenesulfonamidophenol; 2-phenylindane-1,3-diones; chromans such as 2,2-dimethyl-7-t-butyl-6-hydroxychroman; 1,4-dihydropyridines such as 2,6-dimethoxy-3,5-dicarboethoxy-1,4-dihydropyridine; bisphenols such as bis(2-hydroxy-3-t-butyl-5-methylphenyl)methane, 2,2-bis(4-hydroxy-3-methylphenyl) propane, 4,4-ethylidene-bis(2-t-butyl-6-methylphenol), 1,1-bis(2-hydroxy-3,5-dimethylphenyl)-3,5,5-trimethyl-hexane and 2,2-bis(3,5-dimethyl-4-hydroxyphenyl)propane; ascorbic acid derivatives such as 1-ascorbyl palmitate and ascorbyl stearate; aldehydes and ketones such as benzyl and biacetyl; 3-pyrazolidone and a certain kind of indane-1,3-diones; and chromanols such as tocopherol.

According to the present invention, the reducing agent may be added in any form, for example, as a solution, powder, solid microparticle dispersion and the like. The solid microparticle dispersion is performed using a known pulverizing means (e.g., a ball mill, a vibrating ball mill, a sand mill, a colloid mill, a jet mill, a roller mill). At the time of solid microparticle dispersion, a dispersion aid may also be used.

The photosensitive silver halide used in the present invention will be explained in detail.

The photosensitive silver halide for use in the present invention is not particularly limited as for the halogen composition, and silver chloride, silver chlorobromide, silver bromide, silver iodobromide, and silver chloroiodobromide may be used. The halide composition may have a uniform distribution in the grains, or the compositions may change stepwise or continuously in the grains. Silver halide grains having a core/shell structure may be preferably used. Core/shell grains having preferably a double to quintuple structure, more preferably a double to quadruple structure may be used. A technique for localizing silver bromide on silver halide or silver chlorobromide may also be preferably used.

For the preparation of the photosensitive silver halide used for the present invention, methods well known in the art, e.g., the methods described in Research Disclosure, No. 17029 (June, 1978) and U.S. Pat. No. 3,700,458, can be used. More specifically, applicable methods for the present invention include a method comprising the step of adding a halogen-containing compound to a ready prepared organic silver salt to convert a part of silver of the organic silver salt into a photosensitive silver halide, and a method comprising the step of preparing photosensitive silver halide grains by adding a silver-supplying compound and a halogen-supplying compound to a solution of gelatin or another polymer and then mixing the prepared grains with an organic silver salt. In particular, the latter method is preferred for the present invention. As for a grain size of the photosensitive silver halide, smaller grains are desirable to prevent cloudiness of the photosensitive material after image formation. Specifically, the grain size may preferably be not greater than 0.20 μm, preferably from 0.01 to 0.15 μm, more preferably from 0.02 to 0.12 μm. The term "grain size" used herein means "ridge length" of silver halide grains when the silver halide grains are regular crystals in cubic or octahedral form. Where silver halide grains are tabular grains, the term means the diameter of a circle having the same area as a projected area of the main surface of the tabular grain. Where the silver halide grains are irregular crystals, such as spherical or rod-like grains, the term means the diameter of a sphere having the same volume as the grain.

Examples of the form of silver halide grains include a cubic form, octahedral form, tabular form, spherical form, rod-like form and potato-like form. In particular, cubic grains and tabular grains are preferred for the present invention. When tabular silver halide grains are used, an average aspect ratio may be from 100:1 to 2:1, preferably from 50:1 to 3:1. Silver halide grains having round corners are also preferably used in the present invention. Surface index (Miller index) of outer surfaces of the photosensitive silver halide grains is not particularly limited. However, it is desirable that [100] plane be present in a high proportion which can achieve high spectral sensitizing efficiency when a spectral sensitizing dye adsorbed thereto. The proportion of [1001] plane may be not lower than 50%, preferably at least 65%, and more preferably at least 80%. The proportion of [100] plane can be determined using the method described in T. Tani, J. Imaging Sci., 29, 165 (1985), where the difference in adsorption of a sensitizing dye to [1111] plane and [100] plane is utilized.

The photosensitive silver halide grain for use in the present invention may preferably contain a metal or metal complex of Group VII or VIII (group 7 to 10) in the periodic table of elements. The metal or center metal of the metal complex of Group VII or VIII of the periodic table is preferably rhodium, rhenium, ruthenium, osmium or iridium. The metal complex may be used alone, or two or more complexes with the same or different metals may also be used in combination. The metal complex content is preferably from $1\times10^{-9}$ to $1\times10^{-2}$ mole, more preferably from $1\times10^{-8}$ to $1\times10^{-4}$ mole based on one mole of silver. More specifically, the metal complexes having the structures described in JP-A-7-225449 may be used.

As the rhodium compound preferably used in the present invention, a water-soluble rhodium compound may be used. Examples include a rhodium(III) halogenide compounds and rhodium complex salts having a halogen, an amine or an oxalate as a ligand, such as hexachlororhodium(III) complex salt, pentachloroaquorhodium(III) complex salt, tetrachlorodiaquorhodium(III) complex salt, hexabromorhodium(III) complex salt, hexaamminerhodium (III) complex salt and trioxalatorhodium(III) complex salt. The rhodium compound is used after being dissolved in water or an appropriate solvent, and a method commonly used for stabilizing the rhodium compound solution may be applied, for example, a method comprising the step of adding an aqueous solution of hydrogen halide (e.g., hydrochloric acid, hydrobromic acid, hydrofluoric acid) or alkali metal halide (e.g., KCl, NaCl, KBr, NaBr) may be used. Instead of the use of a water-soluble rhodium, different silver halide grains doped beforehand with rhodium may be added and dissolved at the time of preparation of silver halide.

The amount of the rhodium compound is preferably from $1\times10^{-8}$ to $5\times10^{-6}$ mole, more preferably from $5\times10^{-8}$ to $1\times10^{-6}$ mole based on one mole of silver halide.

The rhodium compound may be appropriately added at the time of preparation of the silver halide emulsion grains or at each stages before the coating of the emulsion. The rhodium compound may preferably be added at the time of formation of the emulsion and incorporated in the silver halide grain.

The rhenium, ruthenium or osmium for preferable use in the present invention is added in the form of a water-soluble complex salt described in JP-A-63-2042, JP-A-1-285941, JP-A-2-20852 and JP-A-2-20855. Particularly preferred examples are six-coordinate complex salts represented by the following formula:

$$[ML_6]^{n-}$$

wherein M represents Ru, Re or Os, L represents a ligand, and n represents 0, 1, 2, 3 or 4.

In this case, the counter ion plays no important role and an ammonium or alkali metal may be is used.

Preferred examples of the ligand include a halide ligand, a cyanide ligand, a cyan oxide ligand, a nitrosyl ligand, a thionitrosyl ligand and the like. Specific examples of the complex for use in the present invention are shown below. However, the scope of the present invention is not limited to these examples.

$[ReCl_6]^{3-}$ $[ReBr_6]^{3-}$ $[ReCl_5(NO)]^{2-}$
$[Re(NS)Br_5]_{2-}$ $[Re(NO)(CN)_5]^{2-}$ $[Re(O)_2(CN)_4]^{3-}$
$[RuCl_6]^{3-}$ $[RuCl_4(H_2O)_2]^{-}$ $[RuCl_5(H_2O)]^{2-}$
$[RuCl_5(NO)]^{2-}$ $[RuBr_5(NS)]^{2-}$
$[Ru(CO)_3Cl_3]^{2-}$ $[Ru(CO)Cl_5]^{2-}$ $[Ru(CO)Br_5]^{2-}$
$[OsCl_6]^{3-}$ $[OsCl_5(NO)]^{2-}$ $[Os(NO)(CN)_5]^{2-}$
$[Os(NS)Br_5]^{2-}$ $[Os(O)_2(CN)_4]^{4-}$

The amount of these compound is preferably from $1\times10^{-9}$ to $1\times10^{-5}$ mole, most preferably from $1\times10^{-8}$ to $1\times10^{-6}$ mole based on one mole of silver halide.

These compounds may be added appropriately at the time of preparation of silver halide emulsion grains or at each stages before the coating of the emulsion. The compounds are preferably added at the time of formation of the emulsion and incorporated in silver halide grains.

For the addition of the compound during the grain formation of silver halide for incorporation in silver halide grains, examples of applicable methods include, for example, a method where a metal complex powder or an aqueous solution of the complex dissolved with NaCl or KCl is added to a water-soluble salt or water-soluble halide solution during the grain formation, a method where the compound is added as a "third" solution at the time of simultaneous mixing of a silver salt and a halide solution to prepare silver halide grains by the simultaneous mixing of the three solutions, or a method where a necessary amount of an aqueous metal complex solution is poured into a reaction vessel during the grain formation. Among these, the method is preferred which comprises the step of adding a metal complex powder or an aqueous solution of the complex dissolved with NaCl or KCl to a water-soluble halide solution.

In order to add the compound to the surface of the grain, a necessary amount of an aqueous metal complex solution may be charged into a reaction vessel immediately after the grain formation, during or after completion of the physical ripening, or at the time of chemical ripening.

As the iridium compound preferably used in the present invention, various compounds may be used. Examples include hexachloroiridium, hexammineiridium, trioxalatoiridium, hexacyanoiridium, pentachloronitrosyliridium and the like. The iridium compound is used after being dissolved in water or an appropriate solvent, and a method commonly used for stabilizing the iridium compound solution, more specifically, a method comprising the step of adding an aqueous solution of hydrogen halide (e.g., hydrochloric acid, bromic acid, hydrofluoric acid) or alkali metal halide (e.g., KCl, NaCl, KBr, NaBr) may be used. Instead of using a water-soluble iridium, different silver halide grains doped beforehand with iridium may be added and dissolved at the time of preparation of silver halide.

The silver halide grain for use in the present invention may further contain a metal atom such as cobalt, iron, nickel, chromium, palladium, platinum, gold, thallium, copper and lead. In the case of cobalt, iron, chromium or ruthenium compound, a hexacyano metal complex is preferably used. Specific examples include ferricyanate ion, ferrocyanate ion, hexacyanocobaltate ion, hexacyanochromate ion and hexacyanoruthenate ion. However, the present invention is not limited to these examples. The metal complex may be added, for example, uniformly in the silver halide grain, added in a higher concentration in the core part, or added in a higher concentration in the shell part, and a way of the addition of the metal complex is not particularly limited.

The above-described metal is used preferably in an amount of from $1\times10^{-9}$ to $1\times10^{-4}$ mole based on one mole of silver halide. The metal may be converted into a metal salt in the form of a simple salt, a composite salt or a complex salt, and added at the time of preparation of grains.

The photosensitive silver halide grain may be desalted by water washing according to a method known in the art, such as noodle washing and flocculation. However, the grain may not be desalted in the present invention.

The silver halide emulsion for use in the present invention is preferably subjected to chemical sensitization. The chemical sensitization may be performed using a known method such as sulfur sensitization, selenium sensitization, tellurium sensitization or noble metal sensitization. These sensitization method may be used alone or in any combination. When these sensitization methods are used in combination, a combination of sulfur sensitization and gold sensitization, a combination of sulfur sensitization, selenium sensitization and gold sensitization, a combination of sulfur sensitization, tellurium sensitization and gold sensitization, and a combination of sulfur sensitization, selenium sensitization, tellurium sensitization and gold sensitization, for example, are preferred.

The sulfur sensitization used in the present invention is usually performed by adding a sulfur sensitizer and stirring the emulsion at a high temperature of 40° C. or higher for a given time. A known compound may be used as the sulfur sensitizer, and examples include a sulfur compound contained in gelatin, as well as various sulfur compounds such as thiosulfates, thioureas, thiazoles and rhodanines. Preferred sulfur compounds are thiosulfate and thiourea compounds. The amount of the sulfur sensitizer varies depending on various conditions such as pH and a temperature at the chemical ripening and the size of silver halide grain. A preferred amount may be from $10^{-7}$ to $10^{-2}$ mole, more preferably from $10^{-5}$ to $10^{-3}$ mole based on one mole of silver halide.

As the selenium sensitizer for use in the present invention, a known selenium compound may be used. The selenium sensitization is usually performed by adding a labile and/or non-labile selenium compound and stirring the emulsion at a high temperature of 40° C. or higher for a given time. Examples of the labile selenium compound include the compounds described in JP-B-44-15748, JP-B-43-13489, JP-A-4-25832, JP-A-4-109240 and JP-A-4-324855. Among them, particularly preferred compounds are those represented by formulas (VIII) and (IX) of JP-A-4-324855.

The tellurium sensitizer for use in the present invention is a compound of forming silver telluride, presumably working as a sensitization nucleus, on the surface or inside of a silver halide grain. The rate of the formation of silver telluride in a silver halide emulsion can be examined according to a method described in JP-A-5-313284. Examples of the tellurium sensitizer include diacyl tellurides, bis(oxycarbonyl) tellurides, bis(carbamoyl) tellurides, diacyl tellurides, bis (oxycarbonyl) ditellurides, bis(carbamoyl) ditellurides, compounds having a P=Te bond, tellurocarboxylates, Te-organyltellurocarboxylic acid esters, di(poly)tellurides, tellurides, tellurols, telluroacetals, tellurosulfonates, compounds having a P-Te bond, Te-containing heterocyclic rings, tellurocarbonyl compounds, inorganic tellurium compounds, colloidal tellurium and the like. Specific examples thereof include the compounds described in U.S. Pat. Nos. 1,623,499, 3,320,069 and 3,772,031, British Patent Nos. 235,211, 1,121,496, 1,295,462 and 1,396,696, Canadian Patent No. 800,958, JP-A-4-204640, Japanese Patent Application Nos. 3-53693, 3-131598, 4-129787, J. Chem. Soc. Chem. Commun., 635 (1980), ibid., 1102 (1979), ibid., 645 (1979), J. Chem. Soc. Perkin. Trans., 1, 2191 (1980), S. Patai (compiler), The Chemistry of Organic Selenium and Tellurium Compounds, Vol. 1 (1986), and ibid., Vol. 2 (1987) and the like. The compounds represented by formulas (II), (111) and (IV) of JP-A-5-313284 are particularly preferred.

The amount of the selenium or tellurium sensitizer used in the present invention varies depending on silver halide grains used, chemical ripening conditions or the like. However, it is usually from $10^{-8}$ to $10^{-2}$ mole, preferably from $10^{-7}$ to $10^{-3}$ mole based on one mole of silver halide. The conditions for chemical sensitization in the present invention are not particularly limited. In general, pH of from 5 to 8, pAg of from 6 to 11, preferably from 7 to 10 may be applied, and a temperature may be from 40 to 95° C., preferably from 45 to 85° C.

Noble metal sensitizers for use in the present invention include gold, platinum, palladium and iridium, and particularly, gold sensitization is preferred. Examples of the gold sensitizers used in the present invention include chloroauric acid, potassium chloroaurate, potassium aurithiocyanate, gold sulfide and the like. They can be used in an amount of about $10^{-7}$ mole to about $10^{-2}$ mole based on one mole of silver halide.

In the silver halide emulsion for use in the present invention, a cadmium salt, sulfite, lead salt or thallium salt may be allowed to coexist during the formation or physical ripening of the silver halide grains.

In the present invention, reduction sensitization may be used. Specific examples of the compound used in the reduction sensitization include an ascorbic acid, thiourea dioxide, stannous chloride, aminoiminomethanesulfinic acid, a hydrazine derivative, a borane compound, a silane compound and a polyamine compound. The reduction sensitization may be performed by ripening the grains while keeping the emulsion at a pH of 7 or more or at a pAg of 8.3 or less. The reduction sensitization may also be performed by introducing a single addition part of silver ion during the formation of grains.

To the silver halide emulsion of the present invention, a thiosulfonic acid compound may be added by the method described in European Patent 293917A.

The silver halide emulsion may be used alone in the photosensitive material of the present invention, or two or more of them may be used in combination (for example, those having different average grain sizes, different halogen compositions, or different crystallization properties, or those produces under different sensitization conditions).

The amount of the photosensitive silver halide used in the present invention may preferably be from 0.01 to 0.5 mole, more preferably from 0.02 to 0.3 mole, and more preferably from 0.03 to 0.25 mole based on per mole of the organic silver salt. Examples of a method and conditions for mixing the photosensitive silver halide with a separately prepared organic silver salt include, for example, a method of mixing the silver halide grains and the organic silver salt by means of a high-speed stirrer, a ball mill, a sand mill, a colloidal mill, a vibration mill, a homogenizer or the like, or a method of adding a ready prepared photosensitive silver halide to an organic silver salt at any stage of its preparation. However, the mixing method and conditions are not particularly limited so long as the advantages of the invention can be fully achieved.

The organic silver salt which can be used as a reducible silver salt in the present invention is relatively stable against light, but forms a silver image when it is heated at 80° C. or higher in the presence of an exposed photocatalyst (e.g., a latent image of photosensitive silver halide) and a reducing agent. The organic silver salt may be any organic substance containing a source capable of reducing the silver ion. A silver salt of an organic acid, particularly a silver salt of a long chained aliphatic carboxylic acid (having from 10 to 30, preferably from 15 to 28 carbon atoms) is preferred. A complex of an organic or inorganic silver salt, whose ligand has a complex stability constant of from 4.0 to 10.0, is also preferred. The silver-supplying substance may constitute preferably from about 5 to 70% by weight of the image-forming layer. Examples of preferred organic silver salt includes a silver salt of an organic compound having a carboxyl group. Examples include an aliphatic carboxylic acid silver salt and an aromatic carboxylic acid silver salt. However, the present invention is not limited to these examples. Preferred examples of the aliphatic carboxylic acid silver salt include silver behenate, silver arachidinate, silver stearate, silver oleate, silver laurate, silver caproate, silver myristate, silver palmitate, silver maleate, silver fumarate, silver tartrate, silver linoleate, silver butyrate, silver camphorate and a mixture thereof.

Silver salts of compounds having mercapto or thione group and derivatives thereof may also be used as the organic silver salt. Preferred examples of these compounds include a silver salt of 3-mercapto-4-phenyl-1,2,4-triazole, silver salt of 2-mercaptobenzimidazole, silver salt of 2-mercapto-5-aminothiadiazole, silver salt of 2-(ethylglycolamido)benzothiazole, silver salts of thioglycolic acids such as silver salts of S-alkylthioglycolic acids wherein the alkyl group has 12 to 22 carbon atoms, silver salts of dithiocarboxylic acids such as silver salt of dithioacetic acid, silver salts of thioamides, silver salt of 5-carboxyl-1-methyl-2-phenyl-4-thiopyridine, silver salts of mercaptotriazines, silver salt of 2-mercaptobenzoxazole as well as silver salts of 1,2,4-mercaptothiazole derivatives such as a silver salt of 3-amino-5-benzylthio-1,2,4-thiazole as described in U.S. Pat. No. 4,123,274 and silver salts of thione compounds such as silver salt of 3-(3-carboxyethyl)-4-methyl-4-thiazoline-2-thione as described in U.S. Pat. No. 3,301,678. Compounds containing an imino group may also be used. Preferred examples of such a compound include silver salts of benzotriazole and derivatives thereof, for example, silver salts of benzotriazoles such as silver methylbenzotriazole, silver salts of halogenated benzotriazoles such as silver 5-chlorobenzotriazole as well as silver salts of 1,2,4-triazole and 1-H-tetrazole and silver salts of imidazole and imidazole derivatives as described in U.S. Pat. No. 4,220,709. Various silver acetylide compounds as described, for example, in U.S. Pat. Nos. 4,761,361 and 4,775,613 may also be used.

Although the shape of the organic silver salt that can be used in the present invention is not particularly limited, a needle crystal form having a short axis and a long axis is preferred. In the present invention, the short axis is preferably from 0.01 to 0.20 μm, more preferably from 0.01 to 0.15 μm, and the long axis is preferably from 0.10 to 5.0 μm, more preferably from 0.10 to 4.0 μm. The grain size distribution of the organic silver salt is preferably monodisperse. The term "monodisperse" as used herein means that the percentage of the value obtained by dividing the standard deviation of the length of the short axis or long axis by the length of the short axis or long axis, respectively, is preferably 100% or less, more preferably 80% or less, and still more preferably 50% or less. The shape of the organic silver salt can be determined by the image of an organic silver salt dispersion observed under a transmission electron microscope. Another method for determining the monodispesibility is a method involving obtaining the standard deviation of a volume weight average diameter of the organic silver salt. The percentage (coefficient of variation) of the value obtained by dividing the standard deviation by the volume weight average diameter is preferably 100% or less, more preferably 80% or less, still more preferably 50% or less. The monodispersibility may be determined from the grain size (volume weight average diameter) obtained, for example, by irradiating an organic silver salt dispersed in a solution with a laser ray and determining an autocorrelation function of the fluctuation of the scattered light on the basis of the change in time.

The organic silver salt that can be used in the present invention is preferably desalted. The desalting method is not particularly limited and any known method may be used. Known filtration methods such as centrifugal filtration, suction filtration, ultrafiltration and flocculation washing by coagulation may be preferably used.

For obtaining an organic silver salt solid dispersion having a high S/N ratio and a small grain size and being free from coagulation, a preferable example include a dispersion method comprising the steps of converting a water dispersion, that contains an organic silver salt as an image-forming medium and contains substantially no photosensitive silver salt, to a high-speed flow dispersion, and then releasing the pressure.

The dispersion thus obtained is then mixed with an aqueous photosensitive silver salt solution to produce a coating solution containing the photosensitive image-forming medium. The coating solution enables the manufacture of a heat-developable photographic material exhibiting low haze and low fog, and having high sensitivity. When a photosensitive silver salt coexists at the time of dispersing process under a high-pressure and at high-speed flow, fog frequency may increase and sensitivity may often highly decrease. Furthermore, when an organic solvent is used as a dispersion medium instead of water, haze and fog may increase and sensitivity may likely be decreased. When a conversion method where a part of the organic silver salt in the dispersion is converted into a photosensitive silver salt is used instead of the method of mixing an aqueous photosensitive silver salt solution, sensitivity may likely be decreased.

The above-described water dispersion obtained using conversion under a high-pressure and at high-speed flow is substantially free of a photosensitive silver salt. The content thereof is 0.1 mole % or less based on the light-insensitive organic silver salt. A photosensitive silver salt may not be added intentionally.

The solid dispersing apparatus and technique used for performing the above-described dispersion method in the present invention are described in detail, for example, in Toshio Kajiuchi and Hiromoto Usui, Bunsan-Kei Rheology to Bunsanka Gijutsu (Rheology of Dispersion System and Dispersion Technology), pp.357–403, Shinzan Sha Shuppan (1991), and Kagaku Kogaku no Shinpo (Progress of Chemical Engineering), pp. 184–185, compiled by Corporation Kagaku Kogakukai Tokai Shibu, Maki Shoten (1990). The dispersion method used in the present invention comprises the step of supplying a water dispersion containing at least an organic silver salt under a positive pressure by means of a high-pressure pump or the like into a pipeline, passing the dispersion through a narrow slit provided inside the pipeline, and then subjecting the dispersion to rapid pressure reduction to perform fine dispersion.

As for the high-pressure homogenizer which may be used in the present invention, it is considered that the dispersion into fine grains is generally achieved by dispersion forces such as (a) "shear force" generated at the passage of a dispersoid through a narrow slit under a high pressure at a high speed, and (b) "cavitation force" generated at the time of the release of the dispersoid from the high pressure so as to be under normal pressure. As the dispersion apparatus of this class, an example include the Golline homogenizer previously used. By using this apparatus, the solution to be dispersed is transported under a high pressure and converted into a high-speed flow through a narrow slit on the cylinder surface, and the energy of the flow allows collision of the flow against the peripheral wall surface to achieve emulsification and dispersion. The pressure applied may generally be from 100 to 600 kg/cm$^2$ and the flow velocity may be from several m/sec to 30 m/sec. In order to increase the dispersion efficiency, some apparatuses are designed wherein a part of a high flow velocity is formed into a serrated shape to increase the frequency of collision. Apparatuses capable of dispersion under a higher pressure and at a higher flow velocity have been developed in recent years, and examples include Microfluidizer (manufactured by Microfluidex International Corporation) and Nanomizer (manufactured by Tokusho Kika Kogyo KK).

Examples of the dispersing apparatus which can be suitably used in the present invention include Microfluidizer M-110S-EH (with G10Z interaction chamber), M-110Y (with H10Z interaction chamber), M-140K (with G10Z interaction chamber), HC-5000 (with L30Z or H230Z interaction chamber) and HC-8000 (with E230Z or L30Z interaction chamber), all manufactured by Microfluidex International Corporation.

By using these apparatuses, an aqueous dispersion containing at least an organic silver salt is transported under a positive pressure by means of a high-pressure pump or the like into the pipeline, and the solution is passed though a narrow slit provided inside the pipeline to apply a desired pressure. Then, the pressure in the pipeline is rapidly released to the atmospheric pressure to apply a rapid pressure change to the dispersion to obtain an optimal organic silver salt dispersion for use in the present invention.

In dispersing process of the organic silver salt for use in the present invention, dispersion having a desired grain size may be obtained by controlling the flow velocity, the difference in the pressure before and after at the pressure dropping and the frequency of the processing. From viewpoints of photographic performance and the grain size, the flow velocity is preferably from 200 to 600 m/sec and the difference in the pressure at the pressure dropping is preferably from 900 to 3,000 kg/cm$^2$, and more preferably, the flow velocity is from 300 to 600 m/sec, and the difference in the pressure at the pressure dropping is from 1,500 to 3,000 kg/cm$^2$. The frequency of the dispersion processing may be appropriately chosen as required, and is usually from 1 to 10 times. From a viewpoint of productivity, the frequency is approximately from 1 to 3 times. The water dispersion under a high pressure is preferably not warmed at a high temperature from viewpoints of dispersibility and photographic performance. At a high temperature above 90° C., a grain size may readily become large and fog may be increased. Accordingly, in the present invention, the water dispersion is preferably kept at a temperature of from 5 to 90° C., more preferably from 5 to 80° C., and most preferably from 5 to 65° C., by providing a cooling step before the conversion into a high pressure and high flow velocity, after the pressure drop, or both before the conversion and after the pressure drop. It is particularly effective to provide the cooling step at the time of dispersion under a high pressure of from 1,500 to 3,000 kg/cm$^2$. The cooler may be appropriately selected from a double pipe, a double piper using a static mixer, a multi-tubular exchanger and a coiled heat exchanger, depending on an amount of heat exchange to be treated. The size, wall thickness or material of a pipe may be appropriately selected to increase heat exchange efficiency depending on an applied pressure. In addition, depending on an amount of heat exchange, a refrigerant used in the cooler may be a well water at 20° C. or a chilled water at from 5 to 10° C. cooled by a refrigerator, and if desired, a refrigerant such as ethylene glycol/water at −30° C. may also be used.

In the dispersion operation according to the present invention, the organic silver salt is preferably dispersed in the presence of a dispersant (dispersion aid) soluble in an aqueous solvent. Examples of the dispersion aid include synthetic anion polymers such as polyacrylic acid, copolymer of acrylic acid, maleic acid copolymer, maleic acid monoester copolymer and acrylomethylpropanesulfonic acid copolymer, semisynthetic anion polymers such as carboxymethyl starch and carboxymethyl cellulose, anionic polymers such as alginic acid and pectic acid, compounds described in JP-A-7-350753, known anionic, nonionic or cationic surface active agents, known polymers such as polyvinyl alcohol, polyvinyl pyrrolidone, carboxymethyl cellulose, hydroxypropyl cellulose and hydroxypropylmethyl cellulose, and naturally-occurring polymer compounds such as gelatin, and these may be appropriately selected and used. Polyvinyl alcohols and water-soluble cellulose derivatives are particularly preferred.

The dispersing aid is generally mixed with the organic silver salt in a form of powder or wet cake before the dispersing process, and fed as slurry into a dispersing apparatus. The dispersing aid may be mixed with the organic silver salt beforehand, and then the mixture may be subjected to a treatment such as by heating or with a solvent to form an organic silver salt powder or wet cake. The pH may be controlled with a suitable pH modifier before, during or after the dispersing operation.

Other than the mechanical dispersion, the organic silver salt can be made into microparticles by roughly dispersing the salt in a solvent through pH control, and then changing the pH in the presence of a dispersant. For the operation, an organic solvent may be used as a solvent for the rough dispersion, and such organic solvent can be removed after the formation of grains.

The dispersion prepared can be stored with stirring to prevent precipitation of the grains during storage, or stored in a highly viscous state by means of a hydrophilic colloids (e.g., a jelly state formed with gelatin). Furthermore, the dispersion may contain a preservative in order to prevent proliferation of microorganisms during storage.

The organic silver salt can be used for the present invention in a desired amount. For example, the organic silver salt may preferably be used in an amount of 0.1 to 5 g/m$^2$, more preferably 1 to 3 g/m$^2$ per square meter of the heat-developable image-recording material.

When an additive known as a "color-tone adjustor" capable of improving an image is added, an optical density may sometimes increase. The color-tone adjustor may also be sometimes advantageous in forming a black silver image. The color-tone adjustor may preferably be added in the surface having an image-forming layer in an amount of from 0.1 to 50% by mole, more preferably from 0.5 to 20% by mole based on one mole of silver. The color-tone adjustor may be a so-called precursor that is modified to effectively act only at the time of development.

For the heat-developable photographic material using an organic silver salt, a wide variety of color-tone adjustors are disclosed in JP-A-46-6077, JP-A-47-10282, JP-A-49-5019, JP-A-49-5020, JP-A-49-91215, JP-A-50-2524, JP-A-50-32927, JP-A-50-67132, JP-A-50-67641, JP-A-50-114217, JP-A-51-3223, JP-A-51-27923, JP-A-52-14788, JP-A-52-99813, JP-A-53-1020, JP-A-53-76020, JP-A-54-156524, JP-A-54-156525, JP-A-61-183642, JP-A-4-56848, JP-B-49-10727, JP-B-54-20333, U.S. Pat. Nos. 3,080,254, 3,446,648, 3,782,941, 4,123,282 and 4,510,236, British Patent No. 1,380,795, Belgian Patent No. 841910 and the like. Examples of the color-tone adjustor include phthalimide and N-hydroxyphthalimide; succinimide, pyrazolin-5-ones and cyclic imides such as quinazolinone, 3-phenyl-2-pyrazolin-5-one, 1-phenylurazole, quinazoline and 2,4-thiazolidinedione; naphthalimides such as N-hydroxy-1,8-naphthalimide; cobalt complexes such as cobalt hexaminetrifluoroacetate; mercaptanes such as 3-mercapto-1,2,4-triazole, 2,4-dimercaptopyrimidine, 3-mercapto-4,5-diphenyl-1,2,4-triazole and 2,5-dimercapto-1,3,4-thiadiazole; N-(aminomethyl)aryldicarboxyimides such as N,N-(dimethylamino-methyl)phthalimide and N,N-(dimethylaminomethyl)naphthalene-2,3-dicarboxyimide; blocked pyrazoles, isothiuronium derivatives and certain photobleaching agents, such as N,N'-hexamethylenebis(1-carbamoyl-3,5-dimethylpyrazole), 1,8-(3,6-diazaoctane)bis(iso-thiuroniumtrifluoroacetate) and 2-(tribromomethylsulfonyl)benzothiazole; 3-ethyl-5-[(3-ethyl-2-benzothiazolinylidene)-1-methylethylidene]-2-thio-2,4-oxazolidine dione; phthalazinone, phthalazinone derivatives and metal salts thereof, such as 4-(1-naphthyl) phthalazinone, 6-chlorophthalazinone, 5,7-dimethyloxyphthalazinone or 2,3-dihydro-1,4-phthalazinedione; combinations of phthalazinone with a phthalic acid derivative such as phthalic acid, 4-methylphthalic acid, 4-nitrophthalic acid, and tetrachlorophthalic acid anhydride; phthalazine, phthalazine derivatives such as 4-(1-naphthyl)phthalazine, 6-chlorophthalazine, 5,7-dimethoxyphthalazine, 6-tert-butyl phthalazine, 5,7-dimethyphthalazine, and 2,3-dihydrophthalazine and metal salts thereof; combinations of a phthalazine and a phthalic acid derivative such as phthalic acid, 4-methylphthalic acid, 4-nitrophthalic acid, and tetrachlorophthalic acid anhydride; quinazolinedione, benzoxazine and naphthoxazine derivatives; rhodium complexes which function not only as a color-tone adjustor but as a halide ion source for the formation of silver halide at the site, such as ammonium hexachlororhodate(III), rhodium bromide, rhodium nitrate and potassium hexachlororhodate (III); inorganic peroxides and persulfates such as ammonium disulfide peroxide and hydrogen peroxide; benzoxazine-2,4-diones such as 1,3-benzoxazin-2,4-dione, 8-methyl-1,3-benzoxazin-2,4-dione, and 6-nitro-1,3-benzoxazin-2,4-dione; pyrimidines and asymmetric triazines such as 2,4-dihydroxpyrimidine and 2-hydroxy-4-aminopyrimidine; and azauracil and tetraazapentalene derivatives such as 3,6-dimercapto-1,4-diphenyl-1H,4H-2,3a,5,6a-tetraazapentalene and 1,4-di(o-chlorophenyl)-3,6-dimercapto-1H,4H-2,3a,5,6a-tetraazapentalene and the like.

The color-tone adjustor for use in the present invention may be added in any form, for example, as a solution, a powder, a solid microparticle dispersion and the like. The solid fine particle dispersion is performed using a known pulverization means (e.g., a ball mill, a vibrating ball mill, a sand mill, a colloid mill, a jet mill, a roller mill). At the time of solid microparticle dispersion, a dispersion aid may also be used.

Binders used in the present invention can be selected from well known natural or synthetic resins such as gelatin, poly(vinyl acetal), poly(vinyl chloride), poly(vinyl acetate), cellulose acetate, polyolefins, polyesters, polystyrene, polyacrylonitrile and polycarbonates. Copolymers and terpolymers may also be used. Preferred polymers are polyvinyl butyral, butyl ethyl cellulose, methacrylate copolymer, maleic anhydride ester copolymer, polystyrene and butadiene/styrene copolymer. Two or more of these polymers can be used in combination, if required. The polymers are used in an amount sufficient to hold other components in the polymer, namely, they are used in an effective range to function as a binder. Those skilled in the art can appropriately determine the effective range. In order to hold at least the organic silver salt, a guide of the proportion of the binder to the organic silver salt may preferably range from 15:1 to 1:2, more preferably from 8:1 to 1:1.

At least one of layers constituting the image-forming layer of the present invention is preferably an image-forming layer containing at least 50% by weight of polymer latex described below based on the total binder thereof (hereinafter in the specification, such an image-forming layer is referred to as the "image-forming layer of the present invention", and the polymer latex used for the binder is referred to as the "polymer latex of the present invention"). The polymer latex may be used not only in the image-forming layer, but in a protective layer and a backing layer. When the heat-developable photographic material of the present invention is used for printing in which a dimensional change causes a problem, the polymer latex needs to be used also in the protective layer and the backing layer. The term "polymer latex" used herein means a material comprising water-insoluble hydrophobic polymer fine particles dispersed in a water-soluble dispersion medium. As for a dispersion state, the polymers may be those emulsified in a dispersion medium, those obtained by an emulsion-polymerization, or those obtained by a micell dispersion, or those having a partially hydrophilic structure in their molecule so as to allow molecular dispersion of the molecular chain. The polymer latex for use in the present invention is described in Gosei Jushi Emulsion (Synthetic Resin Emulsion), compiled by Taira Okuda and Hiroshi Inagaki, issued by Kobunshi Kanko Kai (1978), Gosei Latex no Oyo (Application of Synthetic Latex), compiled by Takaaki Sugimura, Yasuo Kataoka, Souichi Suzuki and Keiji Kasahara, issued by Kobunshi Kanko Kai (1993), and Soichi Muroi, Gosei Latex no Kagaku (Chemistry of Synthetic Latex), Kobunshi Kanko Kai (1970) and the like. The dispersion particles preferably have an average particle size of from 1 to 50,000 nm, more preferably from 5 to 1,000 nm. The particle size distribution of the dispersed particles is not particularly limited, and the dispersed particles may have a broad particle size distribution or a monodisperse particle size distribution.

As the polymer latex used for the present invention, a so-called core/shell type latex may be used, as well as the normal polymer latex having a uniform structure. Where the core/shell latex is used, preferable properties may sometimes be obtained when a core and a shell have different glass transition temperatures.

The polymer latexes used as the binders for a protective layer, a backing layer, and an image-forming layer in the present invention have different respective preferred ranges of glass transition temperature (Tg). For the image-forming layer, the glass transition temperature is preferably 40° C. or lower, more preferably from −30° C. to 40° C. to accelerate the diffusion of the photographically useful materials during the heat development. For the protective layer and the backing layer, the glass transition temperature is preferably 25° C. to 70° C. to protect from damages by contact with various instruments.

The polymer latex for use in the present invention preferably has a minimum film-forming temperature (MFT) of from −30 to 90° C., more preferably from 0 to 70° C. In order to control the minimum film-forming temperature, a film-forming aid may be added. The film-forming aid is also called a plasticizer and is an organic compound (usually an organic solvent) capable of decreasing the minimum film-forming temperature of the polymer latex. Such organic compounds are described in, for example, Souichi Muroi, Gosei Latex no Kagaku (Chemistry of Synthetic Latex), Kobunshi Kanko Kai (1970) mentioned above.

Examples of the polymer used as the polymer latex of the present invention include acrylic resin, vinyl acetate resin, polyester resin, polyurethane resin, rubber-based resin, vinyl chloride resin, vinylidene chloride resin, polyolefin resin or a copolymer thereof. The polymer may be a straight-chained polymer, a branched polymer or a cross-linked polymer. The polymer may also be a so-called homopolymer obtained by polymerizing a single monomer or may be a copolymer obtained by polymerizing two or more of monomers. The copolymer may be either a random copolymer or a block copolymer. The polymer has a number average molecular weight of from 5,000 to 1,000,000, preferably from 10,000 to 100,000. If the molecular weight is too small, the image-forming layer may sometimes be deficient in mechanical strength, whereas if the molecular weight is too large, the film-forming property may sometimes be poor.

Examples of the polymer latex used as the binder in the image-forming layer of the heat-developable image-recording material of the present invention include, for example, a methyl methacrylate/ethyl acrylate/methacrylic acid copolymer latex, methyl methacrylate/2-ethylhexyl acrylate/styrene/acrylic acid copolymer latex, styrene/butadiene/acrylic acid copolymer latex, styrene/butadiene/divinylbenzene/methacrylic acid copolymer latex, methyl methacrylate/vinyl chloride/acrylic acid copolymer latex, vinylidene chloride/ethyl acrylate/acrylonitrile/methacrylic acid copolymer latex and the like. Such polymers are commercially available and the following polymers can be used: acrylic resins such as CEBIAN A-4635, 46583, 4601 (all produced by Dicel Kagaku Kogyo Co., Itd), Nipol Lx811, 814, 821, 820, and 857 (all produced by Nippon Zeon Co., Ltd.); polyester resins such as FINETEX ES650, 611, 675, 850 (all produced by Dai-Nippon Ink & Chemicals, Inc.), WD-size and WMS (both produced by Eastman Chemical); polyurethane resins such as HYDRANAP10, 20, 30, and 40 (all produced by Dai-Nippon Ink & Chemicals, Inc.); rubber-based resins such as LACSTAR 7310K, 3307B, 4700H, 7132C, (all produced by Dai-Nippon Ink & Chemicals, Inc.), Nipol Lx416, 410, 438C, and 2507 (all produced by Nippon Zeon Co., Ltd.); vinyl chloride resins such as G351, and G576 (both produced by Nippon Zeon Co., Ltd.); vinylidene chloride resins such as L502, L513 (both produced by Asahi Chemical Industry Co., Ltd.), ARON D7020, D504, and D5071 (all produced by Toagosei Co., Ltd.); and olefin resins such as CHEMIPEARL S120 and SA100 (both produced by Mitsui Petrochemical Industries, Ltd.) and the like. These polymers may be used alone or as a blend of two or more of the polymers, if desired.

The image-forming layer of the present invention preferably contains 50% by weight or more, more preferably 70% by weight or more of the aforementioned polymer latex based on the total binder.

If desired, the image-forming layer of the present invention may contain a hydrophilic polymer in an amount of 50% by weight or less of the total binder, such as gelatin, polyvinyl alcohol, methyl cellulose, hydroxypropyl cellulose, carboxymethyl cellulose and hydroxypropylmethyl cellulose. The amount of the hydrophilic polymer added is preferably 30% by weight or less, more preferably 15% by weight of the total binder in the image-forming layer.

The image-forming layer of the present invention is preferably formed by coating an aqueous coating solution and then drying the coating solution. The term "aqueous" as used herein means that water content of the solvent (dispersion medium) in the coating solution is 60% by weight or more. In the coating solution, the component other than water may be a water-miscible organic solvent such as methyl alcohol, ethyl alcohol, isopropyl alcohol, methyl cellosolve, ethyl cellosolve, dimethylformamide, and ethyl acetate. Examples of the solvent composition include water/methanol=90/10, water/methanol=70/30, water/ethanol=90/10, water/isopropanol=90/10, water/dimethylformamide=95/5, water/methanol/dimethylformamide=80/15/5 and water/methanol/dimethylformamide=90/5/5 (the numerals are in % by weight) as well as water alone.

The total amount of the binder in the image-forming layer according to the present invention is preferably from 0.2 to 30 g/m2, more preferably from 1 to 15 g/m$^2$. The image-forming layer of the present invention may contain a crosslinking agent for cross-linkage, a surfactant for improving coating property and the like.

The heat-developable photographic material of the present invention may contain a sensitizing dye. Any sensitizing dyes may be used so long that they can spectrally sensitize the silver halide grains at a desired wavelength range when they adsorb on the silver halide particles. As the sensitizing dyes, cyanine dyes, merocyanine dyes, complex cyanine dyes, complex merocyanine dyes, holopolar cyanine dyes, styryl dyes, hemicyanine dyes, oxonole dyes, hemioxonole dyes and the like may be used. Preferable sensitizing dyes which can be used in the present invention are described, for example, in Research Disclosure, Item 17643, IV-A (December, 1978, page 23), Item 1831X (August, 1978, page 437) and also in the references cited therein. In particular, sensitizing dyes having a spectral sensitivity suitable for spectral characteristics of light sources of various laser imagers, scanners, image setters, process cameras and the like can advantageously be chosen.

As examples of spectral sensitization to red light, for example, to so-called red light sources such as He-Ne laser, red semiconductor laser, LED and the like, Compounds I-1 to I-38 disclosed in JP-A-54-18726, Compounds I-1 to I-35 disclosed in JP-A-6-75322, Compounds I-1 to I-34 disclosed in JP-A-7-287338, Dyes 1 to 20 disclosed in JP-B-55-39818, Compounds I-1 to I-37 disclosed in JP-A-62-284343, Compounds I-1 to I-34 disclosed in JP-A-7-287338 and the like may be used.

To semiconductor laser light sources having a wavelength range of from 750 to 1,400 nm, spectral sensitization can be advantageously achieved by various known dyes including cyanine dyes, merocyanine dyes, styryl dyes, hemicyanine dyes, oxonol dyes, hemioxonol dyes and xanthene dyes. Useful cyanine dyes are cyanine dyes having a basic nucleus such as thiazoline nucleus, oxazoline nucleus, pyrroline nucleus, pyridine nucleus, oxazole nucleus, thiazole nucleus, selenazole nucleus or imidazole nucleus. Useful and preferred merocyanine dyes are merocyanine dyes having the above-described basic nucleus or an acidic nucleus such as thiohydantoin nucleus, rhodanine nucleus, oxazolidinedione nucleus, thiazolinedione nucleus, barbituric acid nucleus, thiazolinone nucleus, malononitrile nucleus or pyrazolone nucleus. The aforementioned cyanine and merocyanine dyes having an imino group or a carboxyl group are particularly effective. The dye may be appropriately chosen from known dyes described, for example, in U.S. Pat. Nos. 3,761,279, 3,719,495 and 3,877,943, British Patent Nos. 1,466,201, 1,469,117 and 1,422,057, JP-B-3-10391, JP-B-6-52387, JP-A-5-341432, JP-A-6-194781 and JP-A-6-301141.

The dyes most preferably used for the present invention are cyanine dyes having one or more functional groups containing a thioether bond (e.g., cyanine dyes described in JP-A-62-58239, JP-A-3-138638, JP-A-3-138642, JP-A-4-255840, JP-A-5-72659, JP-A-5-72661, JP-A-6-222491, JP-A-2-230506, JP-A-6-258757, JP-A-6-317868, JP-A-6-324425, JP-W-A-7-500926 (the abbreviation "JP-W-A" as used herein means an "international application published in Japanese for Japanese national phase"), and U.S. Pat. No. 5,541,054), dyes having a carboxylic acid group (e.g., dyes disclosed in JP-A-3-163440, JP-A-6-301141, and U.S. Pat. No. 5,441,899), merocyanine dyes, polynuclear merocyanine dyes and polynuclear cyanine dyes (dyes disclosed in JP-A-47-6329, JP-A-49-105524, JP-A-51-127719, JP-A-52-80829, JP-A-54-61517, JP-A-59-214846, JP-A-60-6750, JP-A-63-159841, JP-A-6-35109, JP-A-6-59381, JP-A-7-146537, JP-A-7-146537, JP-A-W-55-50111, British Patent No. 1,467,638, and U.S. Pat. No. 5,281,515) and the like.

Dyes forming J-band are disclosed in U.S. Pat. Nos. 5,510,236, 3,871,887 (Example 5), JP-A-2-96131, JP-A-59-48753 and the like, and they can preferably be used for the present invention.

Each of these sensitizing dyes may be used alone or in any combination. A combination of sensitizing dyes is frequently used, especially for supersensitization. The emulsion may also contain, together with the sensitizing dye, a dye which itself does not have sensitizing effect or a substance which itself does not substantially absorb visible light, but shows supersensitization. Useful sensitizing dyes, combinations of dyes which exhibit supersensitization, and materials which show supersensitization are described in Research Disclosure, Vol. 176, 17643, page 23, Item IV-J (December, 1978), JP-B-49-25500, JP-B-43-4933, JP-A-59-19032, JP-A-59-192242 and the like.

The sensitizing dye may be added to the silver halide emulsion by dispersing the dye directly in the emulsion, or alternatively, the dye may be added to the emulsion after being dissolved in a single solvent or a mixed solvent chosen from water, methanol, ethanol, propanol, acetone, methyl cellosolve, 2,2,3,3-tetrafluoropropanol, 2,2,2-trifluoroethanol, 3-methoxy-1-propanol, 3-methoxy-1-butanol, 1-methoxy-2-propanol and N,N-dimethylformamide.

Furthermore, the sensitizing dye may be added according to the following methods: a method disclosed in U.S. Pat. No. 3,469,987 which comprises the step of dissolving a dye in a volatile organic solvent, dispersing the solution in water or hydrophilic colloid, and then adding the dispersion to an emulsion; a method disclosed in JP-B-44-23389, JP-B-44-27555 and JP-B-57-22091 which comprises the step of dissolving a dye in an acid, and adding the solution to an emulsion, or alternatively, preparing an aqueous solution in the presence of an acid or a base, and then adding the aqueous solution to an emulsion; a method disclosed in U.S. Pat. Nos. 3,822,135 and 4,006,025 which comprises the step of forming an aqueous solution or a colloid dispersion of a dye in the presence of a surface active agent, and then adding the solution or the dispersion to an emulsion; a method disclosed in JP-A-53-102733 and JP-A-58-105141 which comprises the step of dissolving a dye directly in hydrophilic colloid, and adding the dispersion to an emulsion; or a method disclosed in JP-A-51-74624 which comprises the step of dissolving a dye using a compound capable of red shifting, and adding the solution to an emulsion. An ultrasonic wave may also be applied to dissolve the dye.

The sensitizing dye for use in the present invention may be added to a silver halide emulsion in any steps heretofore known to be useful in the preparation of an emulsion. The sensitizing dye may be added at any time or in any step before the coating of the emulsion, for example, in the grain formation process of silver halide and/or before desalting or during the desalting process and/or the time period from desalting until initiation of chemical ripening, as disclosed in U.S. Pat. Nos. 2,735,766, 3,628,960, 4,183,756 and 4,225,666, JP-A-58-184142 and JP-A-60-196749, or immediately before or during the chemical ripening process or in the time period after chemical ripening until coating, as disclosed in JP-A-58-113920. Furthermore, as disclosed in U.S. Pat. No. 4,225,666 and JP-A-58-7629, a single compound or a compound in combination with a structurally different compound may be added in divided portions, for example, one portion is added during grain formation and another is added during or after chemical ripening, or one portion is added before or during chemical ripening and another is added after completion of the chemical ripening. A type of a compound or a type of combination of compounds may be changed during the divided addition.

The amount of the sensitizing dye used in the present invention may be appropriately chosen depending on the performance such as sensitivity or fog. The amount may preferably be from $10^{-6}$ to 1 mole, more preferably from $10^{-4}$ to $10^{-1}$ mole based on one mole of silver halide in the photosensitive layer.

The heat-developable photographic material of the present invention may contain a mercapto compound, a disulfide compound or a thione compound, for example, to control the development by inhibition or acceleration, to improve spectral sensitization efficiency, and to improve storage stability before or after the development.

When a mercapto compound is used in the present invention, a mercapto compound having any chemical structure may be used, and those represented by Ar—$SM^O$ or Ar—S—S—Ar are preferred, wherein $M^O$ is a hydrogen atom or an alkali metal atom, and Ar is an aromatic ring or condensed aromatic ring containing one or more nitrogen, sulfur, oxygen, selenium or tellurium atoms. Preferably, the heteroaromatic ring may be benzimidazole, naphthimidazole, benzothiazole, naphthothiazole, benzoxazole, naphthoxazole, benzoselenazole, benzotellurazole, imidazole, oxazole, pyrazole, triazole, thiadiazole, tetrazole, triazine, pyrimidine, pyridazine, pyrazine, pyridine, purine, quinoline and quinazolinone. The heteroaromatic ring may have a functional group selected from, for example, the group consisting of halogen (e.g., Br, Cl), hydroxyl, amino, carboxyl, an alkyl group (e.g., alkyl having one or more carbon atoms, preferably from 1 to 4 carbon atoms), an alkoxyl group (e.g., alkoxyl having one or more carbon atoms, preferably from 1 to 4 carbon atoms), and an aryl group (which may have one or more functional groups). Examples of the mercapto substituted heteroaromatic compound include 2-mercaptobenzimidazole, 2-mercaptobenzoxazole, 2-mercaptobenzothiazole, 2-mercapto-5-methylbenzimidazole, 6-ethoxy-2-mercaptobenzothiazole, 2,2'-dithiobis(benzothiazole), 3-mercapto-1,2,4-triazole, 4,5-diphenyl-2-imidazolethiol, 2-mercaptoimidazole, 1-ethyl-2-mercaptobenzimidazole, 2-mercaptoquinoline, 8-mercaptopurine, 2-mercapto-4(3H)-quinazolinone, 7-trifluoromethyl-4-quinolinethiol, 2,3,5,6-tetrachloro-4-pyridinethiol, 4-amino-6-hydroxy-2-mercaptopyrimidine monohydrate, 2-amino-5-mercapto-1,3,4-thiadiazole, 3-amino-5-mercapto-1,2,4-triazole, 4-hydroxy-2-mercaptopyrimidine, 2-mercaptopyrimidine, 4,6-diamino-2-mercaptopyrimidine, 2-mercapto-4-methylpyrimidine hydrochloride, 3-mercapto-5-phenyl-1,2,4-triazole, 1-phenyl-5-mercaptotetrazole, sodium 3-(5-mercaptotetrazole)benzenesulfonate, N-methyl-N'-{3-(5-mercaptotetrazolyl)phenyl}urea, 2-mercapto-4-phenyloxazole, N-[3-(mercaptoacetylamino)propyl]carbazole and the like. However, the present invention is not limited to these examples.

The amount of the mercapto compound may preferably be from 0.0001 to 1.0 mole, more preferably from 0.001 to 0.3 mole based on one mole of silver in an emulsion layer.

The image-forming layer (photosensitive layer) for use in the present invention may contain, as a plasticizer or a lubricant, polyhydric alcohols (for example, glycerins and diols described in U.S. Pat. No. 2,960,404), fatty acids or esters described in U.S. Pat. Nos. 2,588,765 and 3,121,060, and silicone resins described in British Patent No. 955,061.

The heat-developable photographic material of the present invention may have a surface protective layer, for example, to prevent adhesion of the image-forming layer.

The surface protective layer used in the present invention may contain any polymers as a binder. The surface protective layer may preferably contain a polymer having carboxyl residues in an amount of from 100 mg/$m^2$ to 5 g/M2 Examples of the polymer having carboxyl residues include, for example, natural polymers (e.g., gelatin, alginic acid), modified natural polymers (e.g., carboxymethyl cellulose, phthalized gelatin), synthetic polymers (e.g., polymethacrylate, polyaciylate, poly(alkyl methacrylate)/acrylate copolymer, polystyrene/polymethacrylate copolymer) and the like. The content of the carboxyl residue in the polymers is preferably from 10 mmol to 1.4 mole per 100 g of the polymer. The carboxylic acid residues may form salts with alkali metal ions, alkaline earth metal ions, organic cations and the like.

For the surface protective layer for use in the present invention, any anti-adhesion material can be used. Examples of the anti-adhesion material include wax, silica particles, styrene-containing elastomeric block copolymer (e.g., styrene/butadiene/styrene, styrene/isoprene/styrene), cellulose acetate, cellulose acetate butyrate, cellulose propionate and a mixture thereof. The surface protective layer may also contain a crosslinking agent for forming cross-linkage or a surface active agent for improving coating property.

The image-forming layer or the protective layer for the image-forming layer according to the present invention may contain a light-absorbing material and a filter dye described in U.S. Pat. Nos. 3,253,921, 2,274,782, 2,527,583 and 2,956,879. The dyes can be mordanted as described, for example, U.S. Pat. No. 3,282,699. The filter dye is preferably used in such an amount that achieves absorbance at an exposure wavelength of from 0.1 to 3, most preferably from 0.2 to 1.5.

The photosensitive layer for use in the present invention may contain a dye or a pigment of various types to improve color tone or prevent irradiation. Any dye or pigment may be used in the photosensitive layer for use in the present invention, and examples thereof include pigments and dyes described in the color index. Specific examples thereof include organic pigments and inorganic pigments such as pyrazoloazole dyes, anthraquinone dyes, azo dyes, azomethine dyes, oxonol dyes, carbocyanine dyes, styryl dyes, triphenylmethane dyes, indoaniline dyes, indophenol dyes and phthalocyanines. Preferred examples of the dye for use in the present invention include anthraquinone dyes (e.g., Compounds 1 to 9 described in JP-A-5-341441, Compounds 3-6 to 3-18 and 3–23 to 3–38 described in JP-A-5-165147), azomethine dyes (e.g., Compounds 17 to 47 described in JP-A-5-341441), indoaniline dyes (e.g., Compounds 11 to 19 described in JP-A-5-289227, Compound 47 described in JP-A-5-341441, Compounds 2-10 and 2-11 described in JP-A-5-165147) and azo dyes (Compounds 10 to 16 described in JP-A-5-341441). These dyes may be added in any form, for example, as a solution, emulsified product or solid microparticle dispersion, or as a dye mordanted with a polymer mordant. The amount of the compound may be determined depending on a desired amount of absorption. In general, the compound is preferably used in an amount of from 1 $\mu$g to 1 g per square meter of the photosensitive material.

The heat-developable photographic material of the present invention is preferably a so-called single-sided photosensitive material comprising a support having on one side thereof at least one photosensitive layer containing a silver halide emulsion and on the other side thereof a backing layer (backing).

In the present invention, the backing layer preferably has a maximum absorption of from about 0.3 to 2.0 in a desired wavelength range. Where the desired range is from 750 to 1,400 nm, the backing layer may preferably have an optical density of from 0.005 to less than 0.5 at from 360 to 750 nm, and more preferably act as an antihalation layer having optical density of from 0.001 to less than 0.3. Where the desired range is less than 750 nm, the backing layer may preferably be an antihalation layer having a maximum absorption of from 0.3 to 2.0 in a desired range of wavelength before the formation of an image, and an optical density of from 0.005 to less than 0.3 at from 360 to 750 nm after the formation of an image. The method for decreasing the optical density after the formation of an image to the above-described range is not particularly limited. For example, a method for reducing the density through decoloration of a dye by heating as described in Belgian Patent No. 733,706, or a method for reducing the density using decoloration by light irradiation described in JP-A-54-17833 may be used.

When antihalation dyes are used in the present invention, the dyes may be any compounds so far that they have an intended absorption in a desired wavelength region and sufficiently low absorption in a visible region, and also provide an absorption spectral property desired for the aforementioned backing layer. Examples of such dye include, as a single dye, the compounds described in JP-A-59-56458, JP-A-2-216140, JP-A-7-13295, JP-A-7-11432, U.S. Pat. No. 5,380,635, JP-A-2-68539 (from page 13, left lower column, line 1 to page 14, left lower column, line 9) and JP-A-3-24539 (from page 14, left lower column to page 16, right lower column); and as a dye which is decolored after the treatment, the compounds described in JP-A-52-139136, JP-A-53-132334, JP-A-56-501480, JP-A-57-16060, JP-A-57-68831, JP-A-57-101835, JP-A-59-182436, JP-A-7-36145, JP-A-7-199409, JP-B-48-33692, JP-A-B-50-16648, JP-B-2-41734 and U.S. Pat. Nos. 4,088,497, 4,283,487, 4,548,896 and 5,187,049. However, the scope of the present invention is not limited to these examples.

The binder suitable for the backing layer of the present invention may be transparent or translucent, and generally colorless. Examples include natural polymers and synthetic resins including homopolymers and copolymers, and other film-forming media. Specific examples include, for example, gelatin, gum arabi, poly(vinyl alcohol), hydroxyethyl cellulose, cellulose acetate, cellulose acetate butyrate, poly(vinyl pyrrolidone), casein, starch, poly(methacrylic acid), poly(methyl methacrylate), poly(vinyl chloride), poly (methacrylic acid), copoly(styrene-maleic anhydride), copoly(styrene-acrylonitrile), copoly(styrene-butadiene), poly(vinyl acetals) (e.g., poly(vinyl formal), poly(vinyl butyral)), poly(esters), poly(urethanes), phenoxy resin, poly (vinylidene chloride), poly(epoxides), poly(carbonates), poly(vinyl acetate), cellulose esters and poly(amides). The binder may be coated and formed after being dissolved in water or an organic solvent or in the form of an emulsion.

The single-sided photographic material of the present invention may contain, in the surface protective layer for the photosensitive emulsion layer (preferably image-forming layer) and/or the backing layer or in the surface protective layer for the backing layer, a matting agent to improve transferability. The matting agent is, in general a fine particle of a water-insoluble organic or inorganic compound. Any matting agent may be employed, and those well known in the art may be used, such as organic matting agents described in U.S. Pat. Nos. 1,939,213, 2,701,245, 2,322,037, 3,262,782, 3,539,344 and 3,767,448, or inorganic matting agents described in U.S. Pat. Nos. 1,260,772, 2,192,241, 3,257,206, 3,370,951, 3,523,022 and 3,769,020. Specific examples of the organic compound which can be used as the matting agent include, for example, water-dispersible vinyl polymers such as polymethyl acrylate, polymethyl methacrylate, polyacrylonitrile, acrylonitrile/$\alpha$-methylstyrene copolymer, polystyrene, styrene/divinylbenzene copolymer, polyvinyl acetate, polyethylene carbonate and polytetrafluoroethylene; cellulose derivatives such as methyl cellulose, cellulose acetate and cellulose acetate propionate; starch derivatives such as carboxy starch, carboxynitrophenyl starch and urea/formaldehyde/starch reaction product; and gelatin hardened with a known hardening agent and hardened gelatin subjected to coacervation hardening so as to be a microcapsule hollow particle. Examples of the inorganic compound include, for example, silicon dioxide, titanium dioxide, magnesium dioxide, aluminum oxide, barium sulfate, calcium carbonate, silver chloride desensitized by a known method, silver bromide desensitized by a known method, glass, diatomaceous earth and the like. The matting agent may be used as a mixture of different substances as required. The size and shape of the matting agent are not particularly limited and the matting agent may have any particle size. A matting agent having a particle size of from 0.1 to 30 $\mu$m may preferably used to carry out the present invention. The matting agent may have either a narrow or broad particle size distribution. However, the matting agent may greatly affect the haze of the photosensitive layer or surface gloss of a coated layer, and accordingly, the particle size, shape and particle size distribution may preferably be controlled to meet a desired purpose at the preparation of the matting agent or by mixing several matting agents.

In the present invention, the backing layer preferably contains a matting agent. The matting degree of the backing layer is from 10 to 1,200 seconds, more preferably from 50 to 700 seconds as indicated by the Beck's smoothness.

In the present invention, the matting agent may preferably be incorporated in the outermost surface layer of the photographic material or a layer which functions as the outermost surface layer, or alternatively, in a layer close to the outer surface or a layer which acts as a so-called protective layer. The matting degree on the surface protective layer for the emulsion layer can be freely chosen so far that the star dust trouble does not occur. The degree may preferably be within a range of from 500 to 10,000 seconds, most preferably from 500 to 2,000 seconds as indicated by the Beck's smoothness.

The heat-developable photographic emulsion for use in the present invention is coated on a support to form one or more layers. In the case of a single layer, the layer must contain an organic silver salt, a silver halide, a developer, a binder, and optionally added materials such as a color-tone adjustor, a coating aid and other auxiliary agents. In the case of a double-layer structure, the first emulsion layer (usually a layer adjacent to the substrate) must contain an organic silver salt and a silver halide, and the second layer or both layers must contain some other components. A double-layer structure comprising a single emulsion layer containing all of the components and a protective topcoat may also be contemplated. A multi-color photosensitive heat-developable photographic material may have the combination of the above-described two layers for each of the colors, or as described in U.S. Pat. No. 4,708,928, a structure comprising a single layer containing all components. In the case of a multi-dye multi-color photosensitive heat-developable material, a functional or non-functional barrier layer is generally provided between respective emulsion layers (photosensitive layers) to keep the emulsion layer away from each other as described in U.S. Pat. No. 4,460,681.

A backside resistive heating layer described in U.S. Pat. Nos. 4,460,681 and 4,374,921 may also be used in the photosensitive heat-developable photographic image system.

In the present invention, a hardening agent may be used in layers such as the image-forming layer (photosensitive layer), the protective layer, and the backing layer. Examples of the hardening agent include polyisocyanates described in U.S. Pat. No. 4,281,060 and JP-A-6-208193, epoxy compounds described in U.S. Pat. No. 4,791,042, and vinyl sulfone-based compounds described in JP-A-62-89048.

In the present invention, a surface active agent may also be used to improve the coating property and or electrostatic charge property. Examples of the surface active agent include nonionic, anionic, cationic and fluorocarbon surface active agents, which may be appropriately chosen and used. Specific examples include fluorocarbon polymer surface active agents described in JP-A-62-170950 and U.S. Pat. No. 5,380,644, fluorocarbon surface active agents described in JP-A-60-244945 and JP-A-63-188135, polysiloxane-based surface active agents described in U.S. Pat. No. 3,885,965, and polyalkylene oxides and anionic surface active agents described in JP-A-6-301140.

The heat-developable photographic emulsion for use in the present invention can generally be coated on a support of various types. Typical examples of the support include polyester film, undercoated polyester film, poly(ethylene terephthalate) film, polyethylene naphthalate film, nitrocellulose film, cellulose ester film, poly(vinyl acetal) film, polycarbonate film, related or resinous material, glass, paper and metal. A flexible substrate, particularly, a paper support coated with baryta and/or partially acetylated α-olefin polymer, preferably, an α-olefin polymer having 2 to 10 carbon atoms, such as polyethylene, polypropylene or ethylene/butene copolymer may typically be used. The support may be either transparent or opaque, and preferably be transparent. Among them, a biaxially stretched polyethylene terephthalate having a thickness of approximately from 75 to 200 μm is particularly preferred.

When a plastic film is passed through a heat-developing apparatus and processed at 80° C. or higher, the film is generally stretched in the dimension. If the processed materials are used as printing photographic materials, the stretch causes a serious problem at the time of precision multi-color printing. Accordingly, in the present invention, it is preferred to use a film designed to cause little change in the dimension by relaxing the internal strain remaining in the film at the biaxial stretching and thereby eliminating the heat shrinkage distortion generated during the heat development. For example, polyethylene terephthalate heat-treated at 100 to 210° C. before a heat-developable photographic emulsion is coated thereon is preferably used. A film having a high glass transition point is also preferred, for example, a film of polyether ethyl ketone, polystyrene, polysulfone, polyether sulfone, polyarylate or polycarbonate may be used.

For the purpose of preventing the electrostatic charge, the heat-developable photographic material of the present invention may comprise a metallized layer or a layer containing a soluble salt (e.g., chloride, nitrate), an ionic polymer described in U.S. Pat. Nos. 2,861,056 and 3,206,312, an insoluble inorganic salt described in U.S. Pat. No. 3,428,451, or tin oxide fine particles described in JP-A-60-252349 and JP-A-57-104931.

To obtain a color image by using the heat-developable photographic material of the present invention, the method described in JP-A-7-13295, from page 10, left column, line 43 to page 11, left column, line 40 may be applied. Examples of a stabilizer for. a color dye image include those described in British Patent 1,326,889, U.S. Pat. Nos. 3,432,300, 3,698,909, 3,574,627, 3,573,050, 3,764,337 and 4,042,394.

The heat-developable photographic emulsion for use in the present invention may be coating by various coating operations such as dip coating, air knife coating, flow coating or extrusion coating using a hopper such as described in U.S. Pat. No. 2,681,294. If desired, two or more layers may be simultaneously coated by a method described in U.S. Pat. No. 2,761,791 and British Patent No. 837,095.

The heat-developable photographic material of the present invention may comprise one or more additional layers such as a dye-accepting layer for accepting a moving dye image, an opaque layer for the case of reflective printing, a protective topcoat layer or a primer layer known in the field of photothermic photographic technology. The photographic material of the present invention is preferably designed so that an image can be formed by the photographic material alone, and a functional layer necessary to form an image, such as an image-receiving layer, may preferably not be prepared as a separate photographic material.

The heat-developable photographic material of the present invention may be developed by any method. The development is usually performed by elevating the temperature of the photographic material after imagewise exposure. Preferred embodiments of the heat-developing apparatus include, as a type of contacting a heat-developable photographic material with a heat source such as heat roller or heat drum, the heat-developing apparatuses described in JP-B-5-56499, Japanese Patent No. 684453, JP-A-9-292695, JP-A-9-297385 and International Patent Publication WO95/30934, and as a non-contacting type, the heat-developing apparatuses described in JP-A-7-13294, International Patent publications WO97/28489, WO97128488 and WO97/28287. A non-contacting type heat-developing apparatus is particularly preferred. The development temperature may preferably be from 80 to 250° C., more preferably from 100 to 140° C. The development time may preferably be from 1 to 180 seconds, more preferably from 10 to 90 seconds.

For preventing uneven processing of the heat-developable photographic material of the present invention due to the above-described change in the dimension at the time of heat development, a method comprising the steps of heating the photographic material at a temperature of from 80° C. to less than 115° C. (preferably 113° C. or lower) for 5 seconds or more so that an image is not formed, and then heat-developing the material at 110° C. or higher (preferably 130° C. or lower) to form an image (the so-called multi-stage heating method) is effective.

The heat-developable photographic material of the present invention may be light-exposed by any method. A preferable light source for the exposure is a laser ray. The laser ray for use in the present invention is preferably a gas laser, YAG laser, dye laser, semiconductor laser or the like. The semiconductor laser and a second harmonic generation device may be used in combination.

The heat-developable photographic material of the present invention has a low haze at the exposure and may sometimes generate interference fringes. For preventing the generation of interference fringes, a technique disclosed in JP-A-5-113548 which comprises the step of entering a laser ray obliquely in the photographic material, and a method of using a multimode laser disclosed in International Patent Publication WO95/31754 are known, and these techniques are preferably used.

The heat-developable photographic material of the present invention is preferably exposed in such a manner that laser rays overlap and the scanning lines are not observed as described in SPIE, Vol. 169, "Laser Printing", pages 116 to 128 (1979), JP-A-4-51043 and International Patent Publication WO95/31754.

An example of the structure of a heat-developing apparatus used for the heat development of the heat-developable photographic material of the present invention is shown in FIG. 1. FIG. 1 depicts a side view of a heat-developing apparatus. The apparatus shown in FIG. 1 comprises carrying-in roller pairs 11 (lower rollers are beating rollers), which carry a heat-developable photographic material 10 into the heating section while making the material in a flat shape with preheating, and carrying-out roller pairs 12, which carry out the heat-developable photographic material 10 after heat development from the heating section while making the material in a flat shape. The heat-developable photographic material 10 is heat-developed while the material is transported from the section of the carrying-in roller pairs 11 to the section of the carrying-out roller pairs 12. Multiple rollers 13 to which the side of the image-forming layer contacts are provided as means for transporting the heat-developable photographic material 10 under the heat development, and a flat surface 14 comprising laminated non-woven fabrics (e.g., composed of aromatic polyamide, Teflon) or the like is provided to which the opposite side as backing surface contacts. The heat-developable photographic material 10 is transported by driving of the multiple rollers 13 contacted with the image-forming layer side, while the back surface slides on the flat surface 14. As a heating means, heaters 15 are provided over the rollers 13 and under the flat surface 14 so that the heat-developable photographic material 10 is heated from the both sides. Examples of the heating means include panel heaters and the like. A clearance between the rollers 13 and the flat surface 14 may vary depending on the materials of the flat surface, and is suitably adjusted so as to allow the conveyance of the heat-developable photographic material 10. The clearance is preferably 0–1 mm.

The material of the surface of the rollers 13 and that of the flat surface 14 are not limited so far that the material have duration at a high temperature and are free from problems for transportation of the heat-developable photographic material 10. The material of the roller surface is preferably silicone rubber, and the material of the flat surface is preferably non-woven fabric made of aromatic polyamide or Teflon (polytetrafluoroethylene). It is preferable that the heating means comprises multiple heaters and a heating temperature of each heater can be adjusted separately.

The heating section is composed of a preheating section A comprising the carrying-in roller pairs 11 and a heat development section B comprising the heaters 15. The temperature of the preheating section A located upstream from the heat development section B is preferably adjusted to be lower than the heat development temperature (for example, by about 10–30° C.), and the temperature and heat development time are desirably adjusted so that they are sufficient for evaporating moisture contained in the heat-developable photographic material 10. The temperature is also preferably chosen to prevent uneven development that is caused at a temperature higher than the glass transition temperature (Tg) of the support.

Moreover, guide panels 16 are provided downstream from the heat development section B, and they constitute gradual cooling section C together with the carrying-out roller pairs 12.

The guide panels 16 are preferably made of a material having low heat conductivity so that a cooling is performed gradually.

The heat-development apparatus is explained with reference to an example shown in the drawing. However, the apparatus is not limited to the example. For example, the heat-development apparatus used for the present invention may have a variety of structures such as disclosed in JP-A-7-13294. For the multi-stage heating method, which is preferably used in the present invention, two or more heat sources at different temperatures may be provided so as to enable successively heating at different temperatures.

EXAMPLES

The present invention will be specifically explained with reference to the following examples. However, the scope of the present invention is not limited to the following examples.

Example 1

Preparation of PET Support

PET having IV (intrinsic viscosity) of 0.66 (measured in phenol/tetrachloroethane=6/4 (weight ratio) at 25° C.) was obtained by using terephthalic acid and ethylene glycol in a conventional manner. The product was pelletized, dried at 130° C. for 4 hours and melted at 300° C., and then extruded from a T-die and rapidly cooled to form an unstretched film having a thickness of 175 μm after thermal fixation.

The film was stretched along the longitudinal direction by 3.3 times using rollers of different peripheral speeds, and then stretched along the transverse direction by 4.5 times using a tenter. The temperatures used for these operations were 110° C. and 130° C., respectively. Then, the film was subjected to thermal fixation at 240° C. for 20 seconds, and relaxed by 4% along the transverse direction at the same temperature. Then, the chuck of the tenter was released, the both edges of the film were knurled, and the film was rolled up at 4 kg/cm$^2$. Thus, a roll of a film having a thickness of 175 μm was obtained.

Surface Corona Discharge Treatment

The both surfaces of the support were subjected to corona discharge treatment at room temperature at a speed of 20 m/minute by using a solid state corona processor Model 6 KVA (manufactured by Piller Co., Ltd.). The readings of electric current and voltage during the treatment indicated that the support received the treatment of 0.375 kV·A·minute/m$^2$. The discharging frequency of the treatment was 9.6 kHz, and the gap clearance between the electrode and the dielectric roll was 1.6 mm.

Preparation of Support with Undercoat Layer (Preparation of Coating Solution for Undercoat Layer A)

A polyester copolymer aqueous dispersion, Pesresin A-515GB (30%, 200 ml, Takamatsu Yushi KK), was added with polystyrene microparticles (1 g, average particle diameter of 0.2 μm) and Surface active agent 1 (1 wt %, 20 ml), and then further added with distilled water up to a volume of 1000 ml to form Coating solution for undercoat layer A.

(Preparation of Coating Solution for Undercoat Layer B)

Distilled water (680 ml) was added with a styrene/butadiene copolymer aqueous dispersion (styrene/butadiene/itaconic acid=47/50/3 [weight ratio], 200 ml, concentration: 30 wt %) and polystyrene microparticles (0.1 g, average particle diameter of 2.5 μm), and further added with distilled water up to a volume of 1000 ml to form Coating solution for undercoat layer B.

(Preparation of Coating Solution for Undercoat Layer C)

Inert gelatin (10 g) was dissolved in distilled water (500 ml), added with an aqueous dispersion (40 wt %, 40 g) of tin oxide-antimony oxide complex microparticles disclosed in JP-A-61-20033, and further added with distilled water up to a volume of 1000 ml to form Coating solution for undercoat layer C.

(Preparation of Support with Undercoat Layer)

After the aforementioned corona discharge treatment, the Coating solution for undercoat layer A was applied on the support by a bar coater in a wet amount of 5 ml/m$^2$, and dried for 5 minutes at 180° C. The dry thickness was about 0.3 μm. Then, the opposite surface (back surface) was subjected to the corona discharge treatment, applied with Coating solution for undercoat layer B by a bar coater in a wet coating amount of 5 ml/m$^2$ so as to obtain a dry thickness of about 0.3 μm, and dried for 5 minutes at 180°

C. The coated layer was further applied with Coating solution for undercoat layer C by a bar coater in a wet coating amount of 3 ml/m$^2$ so as to obtain a dry thickness of about 0.03 $\mu$m, and dried for 5 minutes at 180° C. to obtain a support with undercoat layers.

Preparation of organic acid silver salt dispersion

To a stirred mixture of behenic acid (43.8 g, product name: Edenor C22-85R, Henkel Corp.), distilled water (730 ml) and tert-butanol (60 ml), an aqueous 1N NaOH solution (117 ml) was added over 55 minutes at 79° C., and the mixture was allowed to react for 240 minutes. Then, the mixture was added with an aqueous solution (112.5 ml) of silver nitrate (19.2 g) over 45 seconds, and left stand for 20 minutes for cooling at 30° C. The solids were separated by suction filtration, and the solids were washed with water until the conductivity of the filtrate became 30 $\mu$S/cm. The solids obtained were not dried but handled as wet cakes. To the wet cakes corresponding to 100 g of dry solids, 7.4 g of polyvinyl alcohol (trade name: PVA-205) and water were mixed up to the total amount of 385 g, and the resulting mixture was preliminarily dispersed in a homomixer.

Then, the preliminarily dispersed stock solution was treated three times in a dispersing machine (trade name: Microfluidizer M-110S-EH, manufactured by Microfluidex International Corporation, using G10Z interaction chamber) under a controlled pressure at 1,750 kg/cm$^2$ to obtain Silver behenate dispersion B. The silver behenate particles contained in the silver behenate dispersion obtained above were acicular grains having an average short axis length of 0.04 $\mu$m, average long axis length of 0.8 $\mu$m and variation coefficient of 30%. The grain size was measured by Master Sizer X manufactured by Malvern Instruments Ltd. For cooling operation, a desired dispersion temperature was achieved by providing coiled heat exchangers fixed before and after the interaction chamber and controlling the temperature of a refrigerant.

Preparation of 25 wt % Dispersion of Reducing Agent

To 1,1-bis(2-hydroxy-3,5-dimethylphenyl)-3,5,5-trimethylhexane (80 g) and a 20 wt % aqueous solution of denatured polyvinyl alcohol MP-203 produced by Kuraray Co., Ltd. (64 g), water (176 g) was added, and the mixture was thoroughly stirred to obtain a slurry. The slurry was introduced into a vessel together with zirconia beads having an average diameter of 0.5 mm (800 g), and dispersed by using a dispersing machine (1/4G Sand Grinder Mill, manufactured by Imex) for 5 hours to prepare a reducing agent dispersion. The reducing agent particles contained in the reducing agent dispersion had an average particle size of 0.72 $\mu$m.

Preparation of 20 wt % Dispersion of Mercapto Compound

To 3-mercapto-4-phenyl-5-heptyl-1,2,4-triazole (64 g) and a 20 wt % aqueous solution of denatured polyvinyl alcohol MP-203 produced by Kuraray Co., Ltd. (32 g), water (224 g) was added, and the mixture was thoroughly stirred to obtain a slurry. The slurry was introduced into a vessel together with zirconia beads having an average diameter of 0.5 mm (800 g), and dispersed by using a dispersing machine (1/4G Sand Grinder Mill, manufactured by Imex) for 10 hours to obtain a mercapto compound dispersion. The mercapto compound particles contained in the mercapto compound dispersion obtained as described above had an average particle size of 0.67 $\mu$m.

Preparation of Methanol Solution of Phthalazine Compound

6-Isopropylphthalazine (26 g) was dissolved in methanol (100 ml) and used.

Preparation of 20 wt % Dispersion of Pigment

To C.I. Pigment Blue 60 (64 g) and Demor N produced by Kao Corporation (6.4 g), water (250 g) was added, and the mixture was thoroughly stirred to obtain a slurry. The slurry was introduced into a vessel together with zirconia beads having an average diameter of 0.5 mm (800 g), and dispersed in a dispersing machine (1/4G Sand Grinder Mill, manufactured by Imex) for 25 hours to obtain a pigment dispersion. The pigment particles contained in the pigment dispersion obtained as described above had an average particle size of 0.21 $\mu$m.

Preparation of Silver Halide Grain 1

Distilled water (1421 cc) was added with a 1 wt % potassium bromide solution (6.7 cc), and further added with 1 N nitric acid (8.2 cc) and phthalized gelatin (21.8 g). Separately, Solution a1 was prepared by adding distilled water to silver nitrate (37.04 g) up to 159 ml for dilution, and Solution b1 was prepared by diluting potassium bromide (32.6 g) with distilled water up to a volume of 200 ml. To the aforementioned mixture maintained at 35° C. and stirred in a titanium-coated stainless steel reaction vessel, the whole volume of Solution a1 was added by the controlled double jet method over 1 minute at a constant flow rate while pAg was maintained at 8.1 (Solution b1 was also added by the controlled double jet method). Then, the mixture was added with 3.5 wt % aqueous hydrogen peroxide solution (30 ml), and further added with a 3 wt % aqueous solution of benzimidazole (336 cc). Separately, Solution a2 was prepared by diluting Solution a1 with distilled water up to a volume of 317.5 ml, and Solution b2 was prepared by dissolving dipotassium hexachloroiridate in Solution b1 in such an amount that its final concentration was $1\times10^{-4}$ mole per mole of silver, and diluting the resulting solution with distilled water up to a volume twice as much as the volume of Solution b1, i.e., 400 ml. The whole volume of Solution a2 was added to the mixture again by the controlled double jet method over 10 minutes at a constant flow rate while pAg was maintained at 8.1 (Solution b2 was also added by the controlled double jet method). Then, the mixture was added with a 0.5 wt % solution of 2-mercapto-5-methylbenzimidazole in methanol (50 ml). After pAg was raised to 7.5 with silver nitrate, the mixture was adjusted to pH 3.8 using 1 N sulfuric acid, and the stirring was stopped. Then, the mixture was subjected to precipitation, desalting and washing with water, added with deionized gelatin (3.5 g) and 1 N sodium hydroxide to be adjusted to pH 6.0 and pAg of 8.2 to form a silver halide dispersion.

The grains in the resulting silver halide emulsion were pure silver bromide grains having an average spherical diameter of 0.031 $\mu$m and a variation coefficient of 11% in terms of spherical diameter. The grain size and other parameters were obtained from averages for 1000 grains by using an electron microscope. The [100] face ratio of these grains were determined as 85% by the Kubelka-Munk method.

The aforementioned emulsion was warmed to 50° C. with stirring, added with a 0.5 wt % solution of N,N'-dihydroxy-N",N"-diethylmelamine in methanol (5 ml) and a 3.5 wt % solution of phenoxyethanol in methanol (5 ml), and further added 1 minute later with sodium benzenethiosulfonate in an amount of $3\times10^{-5}$ mole per one mole of silver. Two minutes later, the emulsion was added with a solid dispersion of Spectral sensitization dye 1 (aqueous gelatin solution) in an amount of $5\times10^{-3}$ mole per one mole of silver, and 2 minutes later, the mixture was added with a tellurium compound in an amount of $5\times10^{-5}$ mole per one mole of silver, and ripened for 50 minutes. Just before the completion of the ripening, the emulsion was added with 2-mercapto-5-methylbenzimidazole in an amount of $1\times10^{-3}$ mole per one mole of silver, and its temperature was lowered to complete chemical sensitization and obtain Silver halide grain 1.

Preparation of Silver Halide Grain 2

In 700 ml of water, phthalized gelatin (22 g) and potassium bromide (30 mg) were dissolved, and after the mixture was adjusted at pH 5.0 at a temperature of 35° C., the mixture was added with an aqueous solution (159 ml) containing silver nitrate (18.6 g) and ammonium nitrate (0.9 g) and an aqueous solution containing potassium bromide and potassium iodide at a molar ratio of 92:8 by the control double jet method over 10 minutes while pAg was maintained at 7.7. Then, 476 ml of an aqueous solution containing silver nitrate (55.4 g) and ammonium nitrate (2 g) and a 1 liter of aqueous solution containing 1×10–5 M of dipotassium hexachloroiridate and 1 M of potassium bromide were added by the control double jet method over 30 minutes while pAg was maintained at 7.7, and the mixture was further added with 4-hydroxy-6-methyl-1,3,3a,7-tetrazaindene (1 g). Then, pH of the mixture was lowered to cause coagulation precipitation for desalting treatment, and the mixture was added with phenoxyethanol (0.1 g) and adjusted to pH 5.9 and pAg of 8.2 to complete the preparation of silver iodobromide grains (cubic grains having a core iodine content of 8 mole %, an average iodine content of 2 mole %, an average grain size of 0.05 μm, a variation coefficient of the projected area of 8%, and a [100] face ratio of 88%).

The silver halide grains obtained above was warmed to 60° C. and added with sodium thiosulfonate in an amount of 85 μM per mole of silver and 2,3,4,5,6-pentafluorophenyldiphenylphosphine selenide in an amount of $1.1\times10^{-5}$ mole, a tellurium compound in an amount of $1.5\times10^{-5}$ mole, chloroauric acid in an amount of $3.5\times10^{-8}$ mole and thiocyanic acid in an amount of $2.7\times10^{-4}$ mole. The mixture was ripened for 120 minutes and then rapidly cooled to 40° C. The mixture was further added with $1\times10^{-4}$ mole of Spectral sensitization dye 1 and $5\times10^{-4}$ mole of 2-mercapto-5-methylbenzimidazole, and then rapidly cooled to 30° C. to obtain Silver halide emulsion 2.

Preparation of Coating Solution for Emulsion Layer (Coating Solution for Emulsion Layer)

The organic acid silver salt dispersion obtained above (103 g) and a 20 wt % aqueous solution of polyvinyl alcohol (5 g, PVA-205, Kraray Co., Ltd.) were mixed and maintained at 40° C. To this mixture, a 10 wt % solution of Comparative Compound (1) or a polyhalogenated compound of the present invention (kind and amount are shown in Table 1) in DMF, the aforementioned 25 wt % reducing agent dispersion (23.2 g), the 5 wt % aqueous dispersion of the pigment, C.I. Pigment Blue 60 (4.8 g) and the 20 wt % mercapto compound dispersion (3.1 g) were added. Then, the mixture was added with a 40 wt % SBR latex (106 g) subjected to UF purification and maintained at 40° C. The mixture was stirred sufficiently, and then further added with the solution of phthalazine compound in methanol (6 ml) to obtain an organic acid silver salt solution. Silver halide grain 1 (5 g) and Silver halide grain 2 (5 g) were sufficiently mixed beforehand, and the mixture was admixed with the organic acid silver salt dispersion by a static mixer just before application to prepare a coating solution. The coating solution without further treatment was supplied to a coating die so as to obtain a coated silver amount of 1.4 g/m$^2$.

The viscosity of the aforementioned coating solution for emulsion layer was measured by a Brookfield viscometer of Tokyo Keiki, and found to be 85 [mPa·s] at 40° C. (No. 1 rotor).

The viscosity of the coating solution was measured at 25° C. by an RFS fluid spectrometer produced by Rheometric Far East Co., Ltd., and found to be 1500, 220, 70, 40 and 20 [mPa·s] at shear rates of 0.1, 1, 10, 100 and 1000 [1/second], respectively.

The SBR latex purified by UF (ultrafiltration) was obtained as follows.

The following SBR latex diluted 10 times with distilled water was diluted and purified before use by using an UF-purification module FS03-FC-FUY03A1 (Daisen Membrane System Ltd.) until its ionic conductivity became 1.5 mS/cm. The latex concentration at that ionic conductivity was 40 wt %.

(SBR latex: latex of —St(68)—Bu(29)—AA(3)—)

Average diameter of 0.1 μm, concentration of 45 wt %, equilibrated moisture content (25° C., 60% RH) of 0.6 wt %, ionic conductivity of 4.2 mS/cm (ionic conductivity was measured by using a conductometer CM-30S manufactured by Toa Electronics, Ltd. for a latex stock solution (40 wt %) at 25° C.), pH 8.2.

Preparation of Coating Solution for Intermediate Layer on Emulsion Layer Side (Coating Solution for Intermediate Layer)

To 772 g of a 10 wt % aqueous solution of polyvinyl alcohol PVA-205 (Kuraray Co., Ltd.), and 226 g of a 27.5 wt % latex of methyl methacrylate/styrene/2-ethylhexyl acrylate/hydroxyethyl methacrylate/acrylic acid copolymer (copolymerization weight ratio=59/9/26/5/1), a 5 wt % aqueous solution of Aerosol OT (American Cyanamid Co., 2 ml), benzyl alcohol (4 g), 2,2,4-trimethyl-1,3-pentanediol monoisbutyrate (1 g) and benzoisothiazolinone (10 mg) were added to form a coating solution for intermediate layer, and the solution was supplied to a coating die so as to obtain a coating amount of 5 ml/m$^2$.

The viscosity of the coating solution was measured by a Brookfield viscometer, and found to be 21 [mPa·s] at 40° C. (No. 1 rotor).

Preparation of Coating Solution for First Protective Layer for Emulsion Layer (Coating Solution for First Protective Layer)

Inert gelatin (80 g) was dissolved in water, and the solution was added with a 10 wt % solution of phthalic acid in methanol (138 ml), 1 N sulfuric acid (28 ml), a 5 wt % aqueous solution (5 ml) of Aerosol OT (American Cyanamid Co.) and phenoxyethanol (1 g), and then further added with water up to the total weight of 1000 g to form a coating solution, which was supplied to a coating die to obtain a coating amount of 10 ml/m$^2$.

The viscosity of the coating solution was measured by a Brookfield viscometer, and found to be 17 [mPa·s] at 40° C. (No. 1 rotor).

Preparation of Coating Solution for Second Protective Layer for Emulsion Layer (Coating Solution for Second Protective Layer)

Inert gelatin (100 g) was dissolved in water, and the solution was added with a 5 wt % solution of N-perfluorooctylsulfonyl-N-propylalanine potassium salt (20 ml), a 5 wt % solution (16 ml) of Aerosol OT (American Cyanamid Co.), polymethyl methacrylate microparticles (average diameter: 4.0 fm, 25 g), 1 N sulfuric acid (44 ml) and benzisothiazolinone (10 mg), and then further added with water up to the total amount of 1555 g. The mixture was admixed with 445 ml of an aqueous solution containing 4 wt % of chromium alum and 0.67 wt % of phthalic acid by a static mixer just before application to use as a coating solution for surface protective layer. The coating solution was supplied to a coating die so as to obtain a coating amount of 10 ml/m$^2$.

The viscosity of the coating solution was measured by a Brookfield viscometer, and found to be 9 [mPa·s] at 40° C. (No. 1 rotor).

Preparation of Coating Solution for Back Surface (Preparation of Base Precursor Solid Microparticle Dispersion)

A base precursor compound (64 g) and a surface active agent (Demor N, Kao Corp., 10 g) were mixed with distilled water (246 ml), and the mixture was made into a dispersion by using beads in a sand mill (1/4 Gallon Sand Grinder Mill, manufactured by Imex) to obtain a solid microparticle dispersion of the base precursor having an average particle diameter of 0.2 μm.

(Preparation of Solid Microparticle Dispersion of Dye)

A cyanine dye compound (9.6 g) and sodium p-alkylbenzenesulfonate (5.8 g) were mixed with distilled water (305 ml), and the mixture was made into a dispersion by using beads in a sand mill (1/4 Gallon Sand Grinder Mill, manufactured by Imex) to obtain a solid microparticle dispersion of the dye having an average particle diameter of 0.2 μm.

(Preparation of Coating Solution for Antihalation Layer)

Gelatin (17 g), polyacrylamide (9.6 g), the aforementioned solid microparticle dispersion of base precursor (70 g), the aforementioned solid microparticle dispersion of dye (56 g), polymethyl methacrylate microparticles (average particle diameter of 6.5 μm, 1.5 g), sodium polyethylenesulfonate (2,2 g), a 1 wt % aqueous solution of a coloring dye compound (0.2 g) and $H_2O$ (844 ml) were mixed to prepare a coating solution for antihalation layer.

(Preparation of Coating Solution for Protective Layer)

In a container kept at 40° C., gelatin (50 g), sodium polystyrenesulfonate (0.2 g), N,N'-ethylenebis (vinylsulfonacetamide) (2.4 g), sodium t-octylphenoxyethoxyethanesulfonate (1 g), benzisothiazolinone (30 mg), $C_8F_{17}SO_3K$ (32 mg), $C_8F_{17}SO_2N(CH_3H_7)(CH_2CH_2O)_4(CH_2)_4—SO_{3Na}$ (64 mg) and $H_2O$ (950 ml) were mixed to form a coating solution for protective layer.

The compounds used for Example 1 are shown below.

Surface Active Agent 1

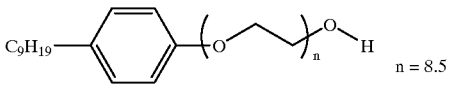

Spectral Sensitizing Dye 1

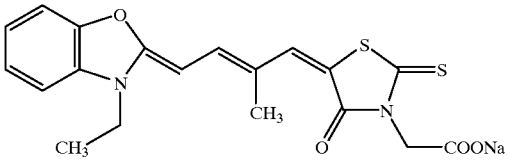

Tellurium Compound

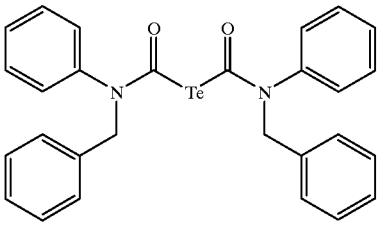

Base Precursor Compound

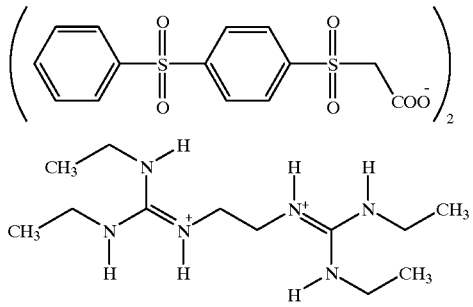

Cyanine Dye Compound

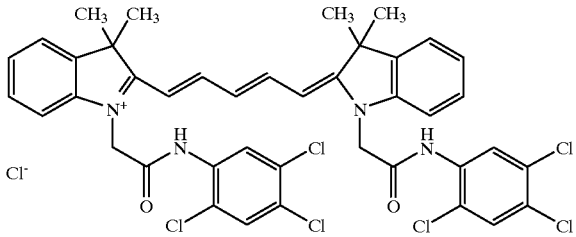

Coloring Dye Compound

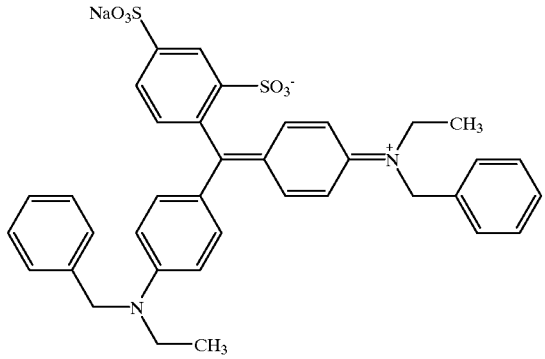

Comparative Compound 1

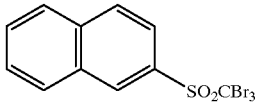

Production of Heat-developable Photographic Material

On the aforementioned support having an undercoat layer, the coating solution for antihalation layer and the coating solution for protective layer were simultaneously applied as stacked layers so that the applied solid content amount of the solid microparticle dye of 0.04 g/m$^2$ and the applied amount of gelatin of 1 g/m$^2$ were obtained, respectively, and then the applied layers were dried to form an antihalation back layer. Then, on the surface opposite to the back surface, an emulsion layer, intermediate layer, first protective layer, and second protective layer were simultaneously applied as stacked layers in the described order from the undercoat layer by the slide bead application method to form a heat-developable photographic material (Table 1). After the application on the back surface, the emulsion layer was applied without winding the material.

The application was performed at a speed of 160 m/min, and the gap between the tip of the coating die and the support was set to be 0.18 mm. The pressure in the reduced pressure chamber was adjusted to be lower than the atmospheric pressure by 392 Pa. In the subsequent chilling zone, the material was blown with air at a dry-bulb temperature of 18° C. and a wet-bulb temperature of 12° C. at an average wind speed of 7 m/second for 30 seconds to cool the coating solutions. Then, in the floating type drying zone in a coiled shape, the material was blown with drying air at a dry-bulb temperature of 30° C. and a wet-bulb temperature of 18° C. at a blowing wind speed of 20 m/second at nozzles for 200 seconds to evaporate the solvents in the coating solutions.

(Evaluation of Photographic Performance)

The prepared heat-developable photographic material was light-exposed by a 647 nm Kr laser sensitometer (maximum output: 500 mW) at an angle of 30° relative to the normal, and treated at 120° C. for 15 seconds (development). The obtained image was evaluated by a densitometer. The measurement results were evaluated in Dmax, fog (Dmin) and sensitivity (a reciprocal of the ratio of the exposed amount necessary for giving a density 1.5 higher than Dmin). The sensitivity was expressed as relative values based on the sensitivity of Heat-developable photographic material 101 that was considered as 100. Separately, each heat-developable photographic material before the treatment was left at 50° C. and 50% humidity under a light-shielded condition for 7 days and then heat-developed as described above. Then, fog (Dmin, fog after heat treatment) was evaluated. The results of the evaluation are shown in Table 1.

TABLE 1

| Heat-developable photographic material | Additive | | Photographic performance | | | | |
|---|---|---|---|---|---|---|---|
| | Kind | Amount (mol/m$^2$) | Dmax | Fog | Sensitivity | Fog (after heat development) | Note |
| 101 | Comparative compound (1) | $1.0 \times 10^{-3}$ | 4.0 | 0.22 | 100 | 0.72 | Comparative |
| 102 | Comparative compound (1) | $2.0 \times 10^{-4}$ | 4.6 | 1.90 | — | 3.50 | Comparative |
| 103 | P-6 | $2.0 \times 10^{-4}$ | 4.5 | 0.22 | 110 | 0.23 | Invention |
| 104 | P-7 | $2.0 \times 10^{-4}$ | 4.4 | 0.21 | 109 | 0.23 | Invention |
| 105 | P-13 | $2.0 \times 10^{-4}$ | 4.5 | 0.19 | 111 | 0.21 | Invention |
| 106 | P-21 | $2.0 \times 10^{-4}$ | 4.6 | 0.20 | 112 | 0.21 | Invention |
| 107 | P-33 | $2.0 \times 10^{-4}$ | 4.5 | 0.18 | 110 | 0.19 | Invention |
| 108 | P-44 | $2.0 \times 10^{-4}$ | 4.5 | 0.19 | 109 | 0.20 | Invention |
| 109 | P-52 | $2.0 \times 10^{-4}$ | 4.6 | 0.21 | 110 | 0.22 | Invention |
| 110 | P-55 | $2.0 \times 10^{-4}$ | 4.5 | 0.25 | 117 | 0.28 | Invention |

(Results)

Comparative compound (1) was able to suppress the fog immediately after the application (Heat-developable photographic material 101). However, the compound failed to suppress the fog after the heat treatment, and Dmin was raised. Further, Comparative compound (1) also failed to suppress the fog at a reduced amount (Heat-developable photographic material 102). In contrast, almost the same levels of suppression of fog as that of Heat-developable photographic material 101 were obtained by the compounds of the present invention even at reduced amount (Heat-developable photographic materials 103–110), and the compound exhibited advantages of high sensitivity and high Dmax. In addition, they suppressed the fog after the heat treatment more effectively than Heat-developable photographic material 101, which apparently revealed their excellent properties.

Example 2

(Preparation of Organic Acid Silver Salt Emulsion A)

Behenic acid (933 g) was added to water (12 liters), and the mixture was added with sodium hydroxide (48 g) and sodium carbonate (63 g) dissolved in water (1.5 liters) while the mixture was maintained at 90° C. After the mixture was stirred for 30 minutes, the temperature of the mixture was lowered to 50° C., and the mixture was added with a 1 wt % N-bromosuccinimide aqueous solution (1.1 liters), and then gradually added with a 17% silver nitrate aqueous solution (2.3 liters) with stirring. Then, the temperature of the mixture was lowered to 35° C., and the mixture was added with a 2 wt % potassium bromide aqueous solutions (1.5 liters) over 2 minutes with stirring, then stirred for 30 minutes, and added with a 1 wt % N-bromosuccinimide aqueous solution (2.4 liters). This aqueous mixture was added with a 1.2 wt % polyvinyl acetate solution in butyl acetate (3,300 g) with stirring, and then left stand for 10 minutes to allow the mixture separated into two layers. Then, the aqueous layer was removed, and the remained gel was washed twice with water. The gel-like mixture of silver behenate and silver bromide was dispersed in a 2.6% solution of polyvinyl butyral (D)enka Butyral, DENKI KAGAKU KOGYO K.K., #3000-K) in 2-butanone (1800 g), and further dispersed with polyvinyl butyral (Butvar B-76, Monsanto Japan, 600 g) and isopropyl alcohol (300 g) to obtain an organic acid silver salt emulsion (acicular grains having an average short axis length of 0.05 $\mu$m, an average long axis length of 1.2 $\mu$m and a variation coefficient of 25%).

The compounds used for Example 2 are shown below.
Sensitization Dye A
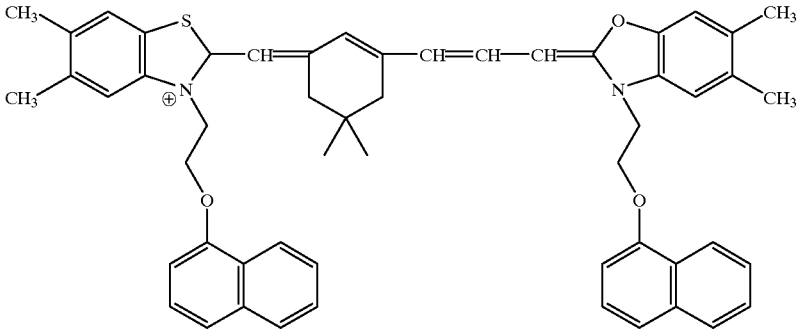
(C-1)
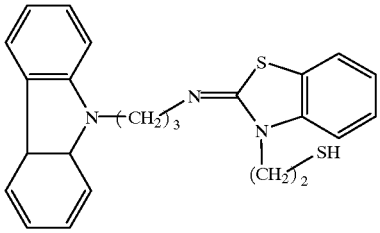
(C-2)
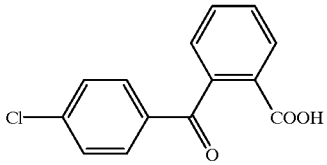
(C-3)
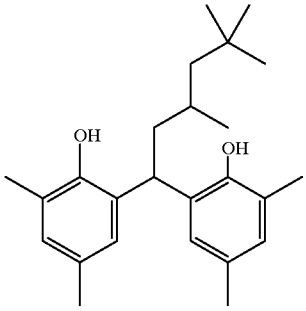
(C-4)
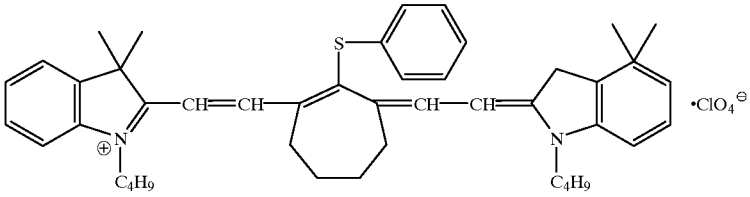
(C-5)
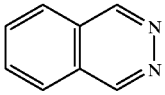

-continued

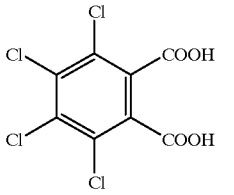

(C-6)

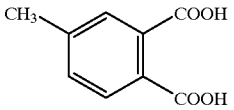

(C-7)

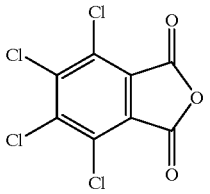

(C-8)

Dye A

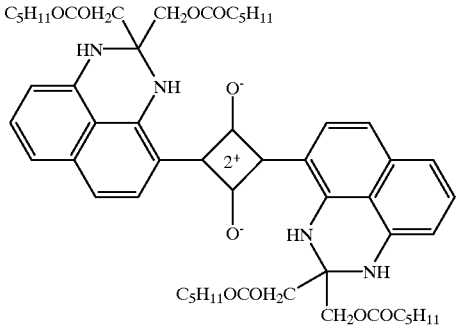

Comparative Compound 2

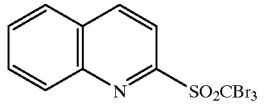

(Preparation of Coating Solution for Emulsion Layer A)

The organic acid silver salt emulsion obtained above was added with the reagents in following amounts per one mole of silver. At 25° C., the emulsion was added with Sensitization dye A (520 mg), Compound (C-1) (1.70 g), 4-chlorobenzophenone-2-carboxylic acid (C-2) (21.5 g), calcium bromide dihydrate (0.90 g), 2-butanone (580 g) and dimethylformamide (220 g) with stirring, and the mixture was left for 3 hours. Then, the mixture was further added with 1,1-bis(2-hydroxy-3,5-dimethylphenyl)-3,5,5-trimethylhexane (C-3) (160 g), Exemplary compound B-42 (2.1 g) as a high contrast agent, Comparative compound (2) or each of the compounds of the present invention shown in Table 2 in each amount shown in Table 2, Dye (C-4) (1.11 g), Sumidur N3500 (polyisocyanate, Sumitomo Bayer Urethane Co., Ltd., 6.45 g), Megafax F-176P (fluorinated surface active agent, 0.60 g, Dai-Nihon Ink Chemical Industry Co., Ltd.), 2-butanone (590 g) and methyl isobutyl ketone (10 g) with stirring.

(Preparation of Coating Solution for Protective Layer for Emulsion Layer A)

CAB171-15S (cellulose acetate butyrate, 65 g, Eastman Chemical Products, Inc.), phthalazine (C-5) (5.6 g), tetrachlorophthalic acid (C-6) (1.91 g), 4-methylphthalic acid (C-7) (2.6 g), tetrachlorophthalic acid anhydride (C-8) (0.67 g), Megafax F-176P (0.36 g) and Sildex H31 (spherical silica having an average size of 3 μm, 2 g, Dokai Chemical K.K.) were dissolved in 2-butanone (1050 g) and dimethylformamide (50 g) to obtain the title solution.

(Preparation of Support with Back Layer)

Polyvinyl butyral (Denka Butyral #4000-2, 6 g, DENKI KAGAKU KOGYO K.K.), Sildex H121 (spherical silica having an average size of 12 μm, 0.2 g, Dokai Chemical K.K.), Sildex H51 (spherical silica having an average size of 5 μm, 0.2 g, Dokai Chemical K.K.) and Megafax F-176P (0.1 g) were added to 2-propanol (64 g) with stirring, dissolved and mixed in the solvent. To this mixture, a mixed solution of Dye A (420 mg) dissolved in methanol (10 g) and acetone (20 g) and a solution of 3-isocyanatomethyl-3,5,5-trimethylhexyl isocyanate (0.8 g) dissolved in ethyl acetate (6 g) were added to form a coating solution.

On a polyethylene terephthalate film having moisture-proof undercoat layers comprising polyvinylidene chloride on the both surfaces, the coating solution of back layer was applied so as to obtain an optical density of 0.7at 780 nm.

On the support prepared as described above, the coating solution for emulsion layer was applied so as to obtain a silver coating amount of 1.6 g/m$^2$, and then the coating solution for protective layer for emulsion layer was applied on the emulsion layer surface so as to obtain a dry thickness of 2.3 μm.

(Evaluation of Photographic Performance)

The prepared heat-developable photographic material was light-exposed by a xenon flash light of an emission time of $10^{-4}$ seconds through an interference filter having a peak at 780 nm and a step wedge, and treated at 117° C. for 20 seconds. The obtained image was evaluated by a densitometer. The measurement results were evaluated in Dmax, fog (Dmin) and sensitivity (a reciprocal of the ratio of the exposure amount necessary for giving a density 1.5 higher than Dmin). The sensitivity was expressed as relative values based on the sensitivity of Heat-developable photographic material 201 that was considered as 100. Separately, each heat-developable photographic material before the treatment was left at 50° C. and 50% humidity under a light-shielded condition for 7 days and then heat-developed as described above. Then, the material was subjected to the same development treatment as described above, and fog (Dmin, fog after heat treatment) was evaluated. The results of this evaluation are shown in Table 2.

TABLE 2

| Heat-developable photographic material | Additive | | Photographic performance | | | | Note |
|---|---|---|---|---|---|---|---|
| | Kind | Amount (mol/m$^2$) | Dmax | Fog | Sensitivity | Fog (after heat development) | |
| 201 | Comparative compound (2) | $5.0 \times 10^{-4}$ | 4.0 | 0.20 | 100 | 0.58 | Comparative |
| 202 | Comparative compound (2) | $1.0 \times 10^{-4}$ | 4.6 | 1.80 | — | 3.00 | Comparative |
| 203 | P-6 | $1.0 \times 10^{-4}$ | 4.5 | 0.19 | 111 | 0.22 | Invention |
| 204 | P-7 | $1.0 \times 10^{-4}$ | 4.5 | 0.19 | 109 | 0.21 | Invention |
| 205 | P-14 | $1.0 \times 10^{-4}$ | 4.6 | 0.20 | 112 | 0.22 | Invention |
| 206 | P-18 | $1.0 \times 10^{-4}$ | 4.5 | 0.21 | 112 | 0.22 | Invention |
| 207 | P-20 | $1.0 \times 10^{-4}$ | 4.5 | 0.20 | 110 | 0.22 | Invention |
| 208 | P-36 | $1.0 \times 10^{-4}$ | 4.6 | 0.19 | 111 | 0.21 | Invention |
| 209 | P-41 | $1.0 \times 10^{-4}$ | 4.5 | 0.20 | 109 | 0.22 | Invention |
| 210 | P-52 | $1.0 \times 10^{-4}$ | 4.6 | 0.19 | 112 | 0.20 | Invention |

(Results)

Excellent results similar to those of Example 1 were obtained even for ultrahigh contrast heat-developable photographic materials.

Example 3

The compounds used for Example 3 are shown below.

Sensitization Dye B

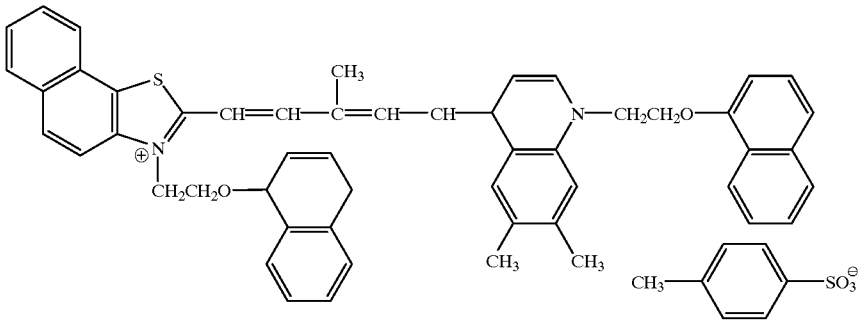

Compound A

Compound B

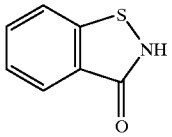

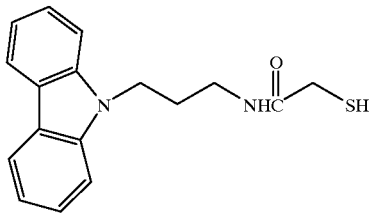

Dye B

Compound D

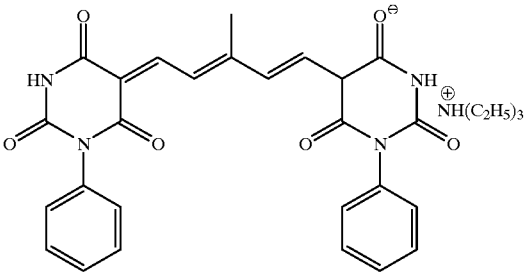

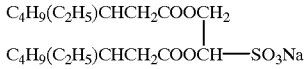

Compound E

Compound F

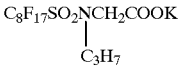

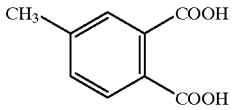

-continued

Comparative Compound 3

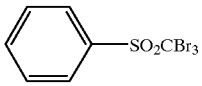

Preparation of Silver Halide Emulsion (Emulsion A)

In 700 ml of water, phthalized gelatin (11 g), potassium bromide (30 mg) and sodium benzenethiosulfonate (10 mg) were dissolved. After the solution was adjusted to pH 5.0 at a temperature of 55° C., 159 ml of an aqueous solution containing silver nitrate (18.6 g) and an aqueous solution containing 1 mole/l of potassium bromide were added by the control double jet method over 6 minutes and 30 seconds while pAg was maintained at 7.7. Then, 476 ml of an aqueous solution containing silver nitrate (55.5 g) and an aqueous halogen salt solution containing 1 mole/l of potassium bromide were added by the control double jet method over 28 minutes and 30 seconds while pAg was maintained at 7.7. Then, the pH was lowered to cause coagulation precipitation for desalting treatment, and then the mixture was added with Compound A (0.17 g) and deionized gelatin (23.7 g, calcium content: 20 ppm or less) and pH and pAg were adjusted to 5.9 and 8.0, respectively. The grains obtained were cubic grains having an average grain size of 0.11 $\mu$m, a variation coefficient of the projected area of 8% and a [100] face ratio of 93%.

The silver halide grains obtained above was warmed up to 60° C., and then added with sodium benzenethiosulfonate (76 $\mu$mol per mole of silver). After 3 minutes, sodium thiosulfate (154 $\mu$mol per mole of silver) was further added, and then the grains were ripened for 100 minutes.

Then, Sensitization Dye B and Compound B were added in amounts of $6.4\times10^{-4}$mole and $6.4\times10^{-3}$ mole, respectively, per one mole of silver halide with stirring while the emulsion was maintained at 40° C. After 20 minutes, the emulsion was rapidly cooled to 30° C. to complete the preparation of Silver halide emulsion A.

Preparation of Organic Acid Silver Salt Dispersion (Organic Acid Silver Salt A)

Arachic acid (6.1 g), behenic acid (39.4 g), distilled water (700 ml), tert-butanol (70 ml) and 1 N aqueous NaOH solution (123 ml) were mixed and allowed to react at 75° C. for 1 hour with stirring, and then the mixture was cooled to 65° C. Then, 112.5 ml of an aqueous solution containing silver nitrate (22 g) was added to the mixture over 45 seconds. The mixture was left stand for 5 minutes, and then the temperature was lowered to 30° C. Subsequently, the solids were separated by suction filtration, and washed with water until the conductivity of the filtrate became 30 $\mu$S/cm. The solids obtained above were not dried but handled as wet cakes. To the wet cakes corresponding to 100 g of dry solids, 5 g of polyvinyl alcohol (trade name: PVA-205) and water were added up to the total amount of 500 g, and the resulting mixture was preliminarily dispersed in a homomixer.

Then, the preliminarily dispersed stock solution was treated three times in a dispersing machine (Microfluidizer M-110S-EH, manufactured by Microfluidex International Corporation, using G10Z interaction chamber) under a controlled pressure of 1,750 kg/cm$^2$ to obtain Organic acid silver salt dispersion A. The organic acid silver salt grains contained in the organic acid silver salt dispersion obtained above were acicular grains having an average short axis length of 0.04 $\mu$m, an average long axis length of 0.8 $\mu$m and a variation coefficient of 30%. The grain size was measured by Master Sizer X manufactured by Malvern Instruments Ltd. For cooling operation, a desired dispersion temperature was achieved by providing coiled heat exchangers fixed before and after the interaction chamber and controlling the temperature of a refrigerant. Thus, Organic acid silver salt A having a silver behenate containt of 85 mole % was obtained.

Preparation of SDolid Microparticle Dispersion of 1,1-bis(2-hydroxy-3,5-dimethyl-phenyl)-3,5,5-trimethylhexane)

To 1,1-bis(2-hydroxy-3,5-dimethylphenyl)-3,5,5-trimethylhexane (70 g), MP Polymer (14 g, MP-203, produced by Kuraray Co., Ltd.) and water (266 ml) were added, and the mixture was thoroughly stirred to form a slurry. The resulting slurry was left stand for 3 hours. Then, 0.5-mm zirconia silicate beads (960 g) were prepared and put together with the slurry into a vessel. The contents in the vessel were dispersed in a dispersing machine (1/4G Sand Grinder Mill, manufactured by Imex) for 5 hours to prepare a reducing agent solid microparticle dispersion. In this dispersion, 80 wt % of the particles had a particle size of from 0.3 to 1.0 $\mu$m.

Preparation of Solid Microparticle Dispersion of Ultrahigh Contrast Agent

To Exemplary compound B-42 (10 g), polyvinyl alcohol (PVA-217, 2.5 g, Kraray Co., Ltd.) and water (87.5 g) were added and the mixture was thoroughly mixed to form a slurry as a solid microparticle dispersion. In this dispersion, 80 wt % of the particles had a particle size of from 0.3 to 1.0 $\mu$m.

Preparation of Coating Solution for Emulsion Layer

The binder, raw materials shown below and Silver halide emulsion A were added to the organic acid silver microcrystal dispersion prepared above in the indicated amounts per one mole of silver in the dispersion, and water was added to the mixture to form a coating solution for emulsion layer.

| | |
|---|---|
| Binder: LACSTAR 3307B (SBR latex, produced by Dai-Nippon Ink & Chemical, Inc., glass transition temperature: 17° C.) | 470 g as solid |
| 1,1-Bis(2-hydroxy-3,5-dimethylphenyl)-3,5,5-trimethylhexane | 110 g as solid |
| Compound of the present invention or Comparative compound (3) | Kind and amount shown in Table 3 |
| 6-Methylbenzotriazole | 1.35 g |
| Polyvinyl alcohol (MP-203, produced by Kuraray Co., Ltd.) | 46 g |
| 6-iso-Butylphthalazine | 0.12 mole |
| Dye B | 0.62 g |
| Silver halide emulsion A | 0.05 mole as Ag |
| Ultrahigh contrast agent (solid dispersion of Exemplary compound B-42) | 8.5 g as B-42 |

Preparation of Coating Solution for Protective Layer for Emulsion Layer

A polymer latex containing 27.5 wt % of solid content (copolymer of methyl methacrylate/styrene/2-ethylhexyl acrylate/2-hydroxyethyl methacrylate/acrylic acid=5919/26/5/1, glass transition temperature of 55° C., 109 g) was added with $H_2O$ (3.75 g), and then with benzyl alcohol (4.5 g) as a film-forming aid, Compound D (0.45 g), Compound E (0.125 g), Compound F (1.70 g) and polyvinyl alcohol (PVA-217, Kuraray Co., Ltd., 0.285 g), and further added with $H_2O$ to a total amount of 150 g to obtain a coating solution.

Preparation of PET Support with Back Layer and Undercoat Layer (1) Support

PET having IV (intrinsic viscosity) of 0.66 (measured in phenol/tetrachloroethane=6/4 (weight ratio) at 25° C.) was obtained by using terephthalic acid and ethylene glycol in a conventional manner. The product was pelletized, dried at 130° C. for 4 hours, melted at 300° C., then extruded from a T-die and rapidly cooled to form an unstretched film having a thickness of 120 μm after thermal fixation.

The film was stretched along the longitudinal direction by 3.3 times using rollers of different peripheral speeds, and then stretched along the transverse direction by 4.5 times using a tenter. The temperatures used for these operations were 110° C. and 130° C., respectively. Then, the film was subjected to thermal fixation at 240° C. for 20 seconds, and relaxed by 4% along the transverse direction at the same temperature. Then, the chuck of the tenter was released, the both edges of the film were knurled, and the film was rolled up at 4.8 kg/cm$^2$. Thus, a roll of a film having a width of 2.4 m, length of 3500 m, and thickness of 120 μm was obtained.

| | |
|---|---|
| (2) Undercoat layer (a) | |
| Polymer latex 1 (styrene/butadiene/hydroxyethylmethacrylate/divinylbenzene = 67/30/2.5/0.5 (% by weight)) | 160 g/m$^2$ |
| 2,4-Dichloro-6-hydroxy-s-triazine | 4 mg/m$^2$ |
| Matting agent (polystyrene, average diameter; 2.4 μm) | 3 mg/m$^2$ |
| (3) Undercoat layer (b) | |
| Alkali-treated gelatin ($Ca^{2+}$ content; 30 ppm, jelly strength; 230 g) | 50 mg/m$^2$ |
| Dye B | Amount giving optical density of 1.0 at 780 nm |
| (4) Electroconductive layer | |
| Julimer ET-410 (Nihon Junyaku Co.) | 96 mg/m$^2$ |
| Gelatin | 50 mg/m$^2$ |
| Compound A | 0.2 mg/m$^2$ |
| Polyoxyethylene phenyl ether | 10 mg/m$^2$ |
| Sumitex Resin M-3 (water-soluble melamine resin, Sumitomo Chemical Co., Ltd.) | 18 mg/m$^2$ |
| Dye B | Amount giving optical density of 1.0 at 780 nm |
| $SnO_2$/Sb (weight ratio: 9/1, acicular grains, short axis/long axis = 20–30, Ishihara Sangyo Kaisha, Ltd.) | 120 mg/m$^2$ |
| Matting agent (Polymethyl methacrylate, average particle size: 5 μm) | 7 mg/m$^2$ |
| (5) Protective layer | |
| Polymer latex 2 (copolymer of methyl methacrylate/styrene/2-ethylhexylacrylate/2-hydroxyethylethyl methacrylate/acrylic acid = 59/9/26/5/1 (% by weight)) | 1000 mg/m$^2$ |
| Polystyrenesulfonate (molecular weight: 1000–5000) | 2.6 mg/m$^2$ |

-continued

| | |
|---|---|
| Cellosol 524 (Chukyo Yushi Co., Ltd.) | 30 mg/m$^2$ |
| Sumitex Resin M-3 (water-soluble melamine compound, Sumitomo Chemical Co., Ltd.) | 218 mg/m$^2$ |

On one side of the support, Undercoat layer (a) and Undercoat layer (b) were successively coated and dried at 180° C. for 4 minutes. Subsequently, on the surface opposite to the surface coated with Undercoat layer (a) and Undercoat layer (b), an electroconductive layer and a protective layer were successively coated and dried at 180° C. for 30 seconds to prepare a PET support having back/undercoat layers.

The PET support with back/undercoat layers obtained above was introduced into a heat treatment zone set at 150° C. and having a total length of 30 m, and subjected to spontaneous transportation at a tension of 1.4 kg/cm$^2$ and a transportation speed of 20 m/minute. Then, the support was passed through a zone at 40° C. for 15 seconds, and taken up at a take-up tension of 10 kg/cm$^2$.

Preparation of Heat-developable Photographic Material

On the undercoat layer of the PET support with back/undercoat layers, the aforementioned coating solution for emulsion layer was coated to give a coated silver amount of 1.6 g/m$^2$. The coating solution for protective layer for emulsion layer was further coated on the emulsion layer so as to obtain solid content of the coated polymer latex of 2.0 g/m$^2$.

Evaluation of Photographic Performance (Light Exposure)

Each of the obtained heat-developable photographic materials was exposed by a xenon flash light of an emission time of $10^{-6}$ seconds through an interference filter having a peak at 780 nm and a step wedge.

(Heat Development)

The light-exposed heat-developable photographic material was heat-developed by using a heat-developing apparatus as shown in FIG. 1, in which the roller surface material was made of silicone rubber, and the flat surface consisted of Teflon non-woven fabric. The heat development was performed at a carrying speed of 20 mm/second in the preheating section at 90–100° C. for 15 seconds, in the heat development section at 120° C. for 20 seconds and in the gradual cooling section for 15 seconds. The temperature precision as for the transverse direction was ±1° C.

(Evaluation of Photographic Performance)

The obtained image was evaluated by Macbeth TD904 densitometer (visible density). The measurement results were evaluated in Dmax, fog (Dmin) and sensitivity (a reciprocal of the ratio of the exposure amount necessary for giving a density 1.5 higher than Dmin). The sensitivity was expressed by a relative value based on the sensitivity of Heat-developable photographic material 301 that was considered as 100. Separately, each heat-developable photographic material before the treatment was left at 50° C. and 50% humidity under a light-shielded condition for 7 days. Then, the material was subjected to the same development treatment as those described above, and fog (Dmin, fog after heat treatment) was evaluated. The results of this evaluation are shown in Table 3.

TABLE 3

| Heat-developable photographic material | Additive | | Photographic performance | | | | Note |
|---|---|---|---|---|---|---|---|
| | Kind | Amount (mol/m$^2$) | Dmax | Fog | Sensitivity | Fog (after heat development) | |
| 301 | Comparative compound (3) | $1.0 \times 10^{-3}$ | 4.1 | 0.21 | 100 | 0.81 | Comparative |
| 302 | Comparative compound (3) | $2.0 \times 10^{-4}$ | 4.5 | 1.95 | — | 3.51 | Comparative |
| 303 | P-6 | $2.0 \times 10^{-4}$ | 4.6 | 0.21 | 110 | 0.22 | Invention |
| 304 | P-7 | $2.0 \times 10^{-4}$ | 4.5 | 0.20 | 109 | 0.21 | Invention |
| 305 | P-14 | $2.0 \times 10^{-4}$ | 4.5 | 0.19 | 109 | 0.21 | Invention |
| 306 | P-18 | $2.0 \times 10^{-4}$ | 4.6 | 0.20 | 111 | 0.21 | Invention |
| 307 | P-20 | $2.0 \times 10^{-4}$ | 4.5 | 0.20 | 112 | 0.22 | Invention |
| 308 | P-36 | $2.0 \times 10^{-4}$ | 4.6 | 0.19 | 110 | 0.21 | Invention |
| 309 | P-41 | $2.0 \times 10^{-4}$ | 4.5 | 0.20 | 109 | 0.22 | Invention |
| 310 | P-52 | $2.0 \times 10^{-4}$ | 4.5 | 0.20 | 111 | 0.21 | Invention |

(Results)

Excellent results similar to those of Examples 1 and 2 were obtained for the heat-developable photographic materials of the present invention.

What is claimed is:

1. A heat-developable photographic material which comprises, on a support, (a) a reducible silver salt, (b) a reducing agent, (c) a binder, and (d) at least one polyhalogenated compound represented by the following formula (1):

$$W—L—Q—Y^1—C(Z^1)(Z^2)—X^1$$

wherein $Z^1$ and $Z^2$ represent a halogen atom, $X^1$ represents a hydrogen atom or an electron withdrawing group, $Y^1$ represents —CO— group or —$SO_2$— group, Q represents an arylene group or a divalent heterocyclic group, L represents a bridging group, and W represents carboxyl group or a salt thereof, slufo group or a salt thereof, phosphoric acid group or a salt thereof, a hydroxyl group, a quaternary ammonium group, or a polyethyleneoxy group.

2. The heat-developable photographic material according to claim 1, which contains a photosensitive silver halide.

3. The heat-developable photographic material according to claim 1, wherein $Z^1$ and $Z^2$ represent a bromine atom.

4. The heat-developable photographic material according to claim 1, wherein $X^1$ represents a halogen atom.

5. The heat-developable photographic material according to claim 4, wherein $X^1$ represents a bromine atom.

6. The heat-developable photographic material according to claim 1, wherein $Y^1$ represents —$SO_2$— group.

7. The heat-developable photographic material according to claim 1, wherein Q is an arylene group.

8. The heat-developable photographic material according to claim 7, wherein Q is phenylene group.

9. The heat-developable photographic material according to claim 1, wherein L represents an alkylene group, —O— group, —CONR— group, —$SO_2$NR— group, or a group formed by a combination thereof wherein R represents a hydrogen atom or an alkyl group, provided that 1, contains at least one of —O— group, —NRCO— group, and —$SO_2$NR— group.

10. The heat-developable photographic material according to claim 1, wherein W represents carboxyl group or a salt thereof, slufo group or a salt thereof, or hydroxyl group.

11. The heat-developable photographic material according to claim 1, wherein $Z^1$, $Z^2$ and $X^1$ represent a bromine atom, $Y^1$ represents —$SO_2$— group, Q represents an arylene group or a divalent heterocyclic group, L, represents an alkylene group, —O— group, —CONR— group, —$SO_2$NR— group, or a group formed by a combination thereof wherein R represents a hydrogen atom or an alkyl group, provided that L contains at least one of —O— group, —NRCO— group, and —$SO_2$NR— group, and W represents carboxyl group or a salt thereof, slufo group or a salt thereof, phosphoric acid group or a salt thereof, a hydroxyl group, a quaternary ammonium group, or a polyethyleneoxy group.

12. The heat-developable photographic material according to claim 11, wherein Q is an arylene group.

13. The heat-developable photographic material according to claim 12, wherein Q is phenylene group.

14. The heat-developable photographic material according to claim 1, which contains an ultrahigh contrast agent.

15. The heat-developable photographic material according to claim 11, which contains an ultrahigh contrast agent.

* * * * *